US012575646B2

(12) United States Patent
Fallon et al.

(10) Patent No.: US 12,575,646 B2
(45) **Date of Patent: *Mar. 17, 2026**

(54) ARTICLE OF FOOTWEAR HAVING A HARNESS SYSTEM

(71) Applicant: Under Armour, Inc., Baltimore, MD (US)

(72) Inventors: Kevin Fallon, Baltimore, MD (US); Kort Neumann, Baltimore, MD (US); Antonio Zea, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/792,744

(22) Filed: Aug. 2, 2024

(65) Prior Publication Data

US 2024/0389716 A1 Nov. 28, 2024

Related U.S. Application Data

(63) Continuation of application No. 17/198,929, filed on Mar. 11, 2021, now Pat. No. 12,053,056, which is a continuation of application No. 15/955,172, filed on Apr. 17, 2018, now Pat. No. 10,952,504.

(60) Provisional application No. 62/486,287, filed on Apr. 17, 2017.

(51) Int. Cl.

| | |
|---|---|
| ***A43C 11/14*** | (2006.01) |
| ***A43B 5/00*** | (2022.01) |
| ***A43B 5/02*** | (2006.01) |
| ***A43B 7/18*** | (2006.01) |
| ***A43B 7/22*** | (2006.01) |
| ***A43C 11/16*** | (2006.01) |

(52) U.S. Cl.
CPC ..... *A43C 11/14* (2013.01); *A43B 5/00* (2013.01); *A43B 5/02* (2013.01); *A43B 7/18* (2013.01); *A43B 7/22* (2013.01); *A43C 11/16* (2013.01)

(58) Field of Classification Search
None
See application file for complete search history.

(56) References Cited

U.S. PATENT DOCUMENTS

| | | | | |
|---|---|---|---|---|
| 3,327,410 | A | 6/1967 | Park, Sr. et al. | |
| 4,620,378 | A | 11/1986 | Sartor et al. | |
| 4,937,953 | A * | 7/1990 | Walkhoff ..... | A43C 11/165 36/117.7 |
| 5,117,567 | A | 6/1992 | Berger et al. | |
| 5,177,882 | A | 1/1993 | Berger et al. | |
| 5,425,185 | A | 6/1995 | Gansler et al. | |
| 5,511,325 | A | 4/1996 | Hieblinger et al. | |

(Continued)

*Primary Examiner* — Jila M Mohandesi
(74) *Attorney, Agent, or Firm* — Maginot, Moore & Beck, LLP

(57) ABSTRACT

An article of footwear includes a sole and an upper that includes a heel end, a toe end, a medial side, and a lateral side. The upper defines a throat between the medial and lateral sides, and the sole and the upper jointly defining a foot cavity. The article of footwear further includes a support member extending from a first side of the article of footwear to a second side of the article of footwear, and an actuator fixedly attached to the support member at the first side of the article of footwear. A securing strap extends across the throat and has a first end operably connected to the actuator and a second end fixedly connected to the second side of the article of footwear.

19 Claims, 17 Drawing Sheets

(56) References Cited

U.S. PATENT DOCUMENTS

| | | | | |
|---|---|---|---|---|
| 6,416,074 | B1 | 7/2002 | Maravetz et al. | |
| 6,792,702 | B2 * | 9/2004 | Borsoi | A43B 5/0405 36/117.6 |
| 6,922,917 | B2 | 8/2005 | Kerns et al. | |
| 7,428,789 | B2 | 9/2008 | Holzer et al. | |
| 7,490,417 | B2 | 2/2009 | Petrie | |
| 7,818,899 | B2 | 10/2010 | Dinndorf et al. | |
| 7,963,049 | B2 | 6/2011 | Messmer et al. | |
| 8,087,188 | B2 | 1/2012 | Labbe | |
| 8,857,077 | B2 | 10/2014 | Kahatsu et al. | |
| 9,078,490 | B2 | 7/2015 | Gerber et al. | |
| 9,357,807 | B2 | 6/2016 | Berns et al. | |
| 9,480,299 | B2 | 11/2016 | Dinndorf et al. | |
| 9,770,070 | B2 * | 9/2017 | Cotterman | A43C 11/20 |
| 10,499,709 | B2 * | 12/2019 | Pollack | A43C 1/04 |
| 2005/0022427 | A1 | 2/2005 | Kerns et al. | |
| 2006/0196083 | A1 | 9/2006 | Martin et al. | |
| 2010/0319216 | A1 | 12/2010 | Grenzke et al. | |
| 2012/0079741 | A1 | 4/2012 | Kohatsu | |
| 2015/0143720 | A1 * | 5/2015 | Avar | A43B 1/04 36/107 |
| 2016/0044994 | A1 * | 2/2016 | Soderberg | A43C 11/165 36/97 |
| 2016/0058127 | A1 * | 3/2016 | Burns | F41C 33/0209 36/58.5 |
| 2016/0242498 | A1 | 8/2016 | Sakamoto et al. | |
| 2016/0309844 | A1 | 10/2016 | Smith et al. | |
| 2016/0324257 | A1 | 11/2016 | Ko et al. | |
| 2016/0338449 | A1 * | 11/2016 | Steuerwald | A43B 5/14 |

* cited by examiner

ARTICLE OF FOOTWEAR HAVING A HARNESS SYSTEM

CROSS-REFERENCE TO RELATED APPLICATIONS

This application is a continuation of U.S. patent application Ser. No. 17/198,929, filed Mar. 11, 2021 (now U.S. Pat. No. 12,053,056), which is a continuation of U.S. patent application Ser. No. 15/955,172, filed Apr. 17, 2018 (now U.S. Pat. No. 10,952,504), which claims priority from U.S. provisional patent application No. 62/486,287, filed Apr. 17, 2017, the entire disclosures of which are hereby incorporated by reference.

TECHNICAL FIELD

This disclosure relates generally to articles of apparel, and more particularly to articles of footwear.

BACKGROUND

Articles of footwear are designed to be worn on users' feet to protect the feet, provide stability and comfort, and, in some instances, to improve performance. It is typically advantageous for the article of footwear to be secured tightly to the foot to prevent movement relative to the foot and the article of footwear, which can cause reduced athletic performance, reduced stability, and discomfort for the wearer. Conventional shoes include a lace that is threaded through several openings, and which the user tightens and ties to secure the upper of the article of footwear around the middle region of the user's foot. In the conventional shoe, however, the laces do not fully restrain the foot from longitudinal movement within the shoe. An improved article of footwear that secures the article of footwear to the user's foot would therefore be desirable.

SUMMARY

In one embodiment, an article of footwear includes a sole and an upper that includes a heel end, a toe end, a medial side, and a lateral side. The upper defines a throat between the medial and lateral sides, and the sole and the upper jointly defining a foot cavity. The article of footwear further includes a support member extending from a first side of the article of footwear to a second side of the article of footwear, and an actuator fixedly attached to the support member at the first side of the article of footwear. A securing strap extends across the throat and has a first end operably connected to the actuator and a second end fixedly connected to the second side of the article of footwear.

In another embodiment, an article of footwear comprises a sole, an upper coupled to the sole to define a foot cavity, and a harness system. The harness system includes a tongue disposed within the foot cavity, the tongue being oriented along a longitudinal axis of the article of footwear. The harness system further includes a securing strap extending along a transverse dimension of the article of footwear, wherein the securing strap is coupled to the tongue, and an actuator mechanism in communication with the securing strap.

In yet another embodiment, an article of footwear comprises a sole, an upper, and a harness system. The upper has an exterior surface and defines a throat between a medial side of the article of footwear and a lateral side of the article of footwear. The sole and the upper jointly define a foot cavity. The harness system comprises a securing strap and an adjustment mechanism. The securing strap extends across the throat from the medial side to the lateral side, and the securing strap has a first end and a second opposite end, the first end being fixedly attached to at least one of the upper and the sole. The adjustment mechanism includes an actuator operably connected to the second end of the securing strap, and the adjustment mechanism is configured to tighten and loosen the securing strap.

DETAILED DESCRIPTION

Figure 1:
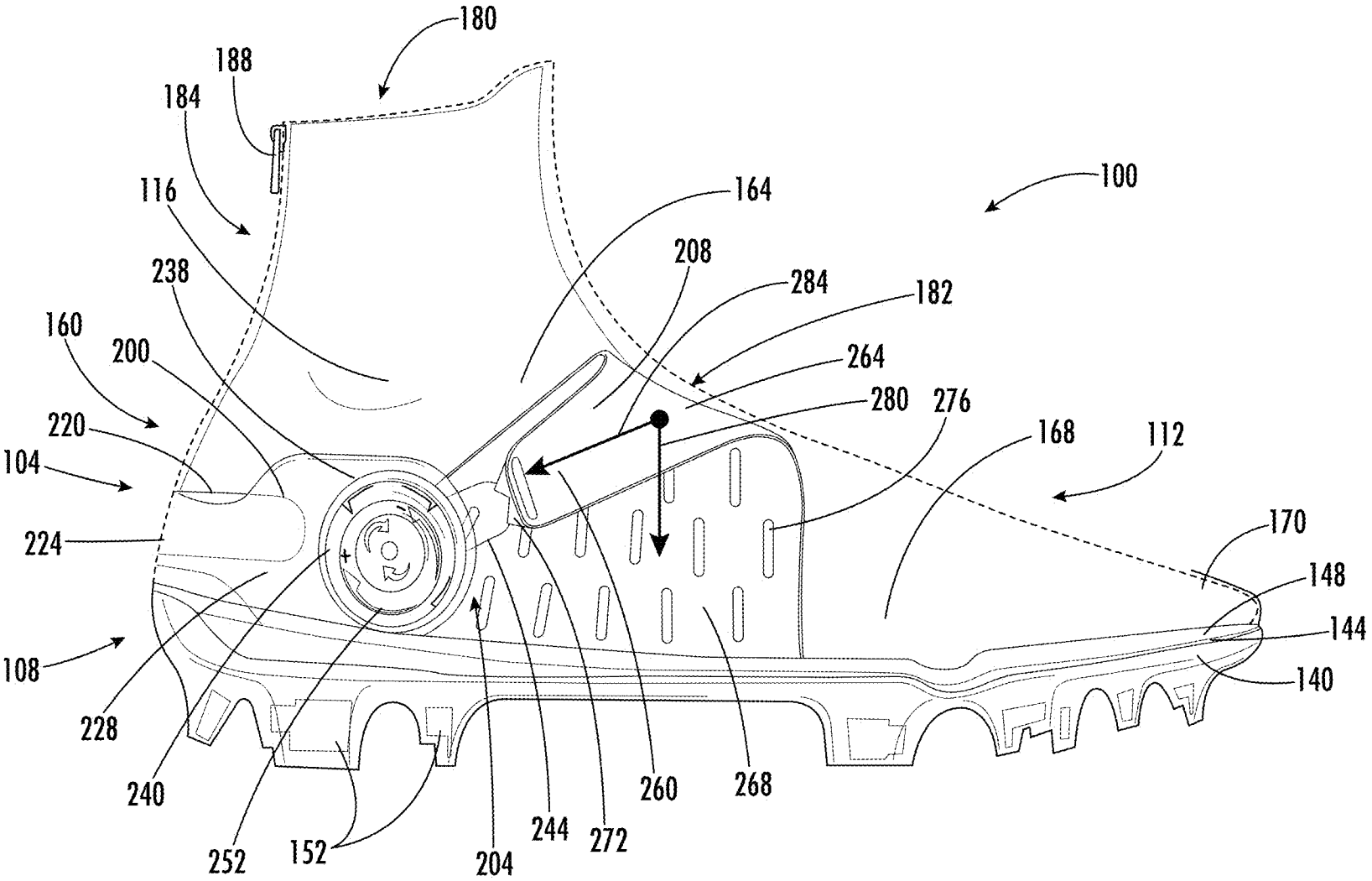
FIG. 1 is a lateral side view illustrating an article of footwear, shown in shadow, having a harness system according to the disclosure.

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

As used herein, an "article of footwear" refers to an article of apparel designed and configured to be worn on a user's foot. Examples of articles of footwear include, but are not limited to: athletic shoes such as basketball shoes, running shoes, walking shoes, and tennis shoes; athletic cleated or spiked shoes such as football cleats, soccer cleats, baseball cleats, lacrosse cleats, and track spikes; boots such as hiking boots or skiing boots; ice skates; and roller skates or roller blades. The illustrated embodiments depict football cleats, though the reader should appreciate that the heel fixing systems described herein may be used with any desired article of footwear.

FIG. 1 illustrates an article of footwear, in particular a shoe 100 configured as a cleated football shoe, having a harness system 104 according to the disclosure. The shoe 100 includes a sole 108 and an upper 112, which jointly define a foot cavity 116. The harness system 104 disclosed herein is configured to substantially enclose a heel region of a user's foot so as to fix the foot securely in the foot cavity 116 and to reduce movement of the foot within the foot cavity 116.

The sole 108 includes an outsole 140, a midsole 144, and an insole 148. In the illustrated embodiment, the outsole 140 is a plate formed of a hard plastic material, or other substantially rigid material, and includes a plurality of traction elements 152. In the illustrated embodiment, the cleats are molded integrally with the plate and are arranged in an American football configuration. In other embodiments, the cleats are arranged in a soccer configuration, a baseball configuration, a lacrosse configuration, or another desired configuration. In some further embodiments, the outsole does not include cleats, and instead includes track or turf spikes, or is flat, for example for a running shoe, walking shoe, tennis shoe, basketball shoe, indoor soccer shoe, or indoor lacrosse shoe.

The midsole 144 is interposed between the outsole 140 and the insole 148 and is configured to provide cushioning or absorb shocks to the shoe 100. The insole 148 is arranged on the inside of the shoe 100, and provides a cushioned surface on the interior of the foot cavity 116 for user comfort.

The upper 112 includes a heel region 160, a lateral quarter region 164, a medial quarter region 166, a vamp region 168, and a toe cage region 170. In some embodiments, the upper 112 is formed of a continuous single layer or multilayer material. In other embodiments, different regions of the upper 112 are formed of different single layer or multilayer materials. For example in one embodiment, the toe cage region 170, the vamp region 168, and a portion of the lateral and medial quarter regions 164, 166 are formed of one material, while the heel region 160 and the remaining portion of the lateral and medial quarter regions 164, 166 are formed of another material.

Figure 5:
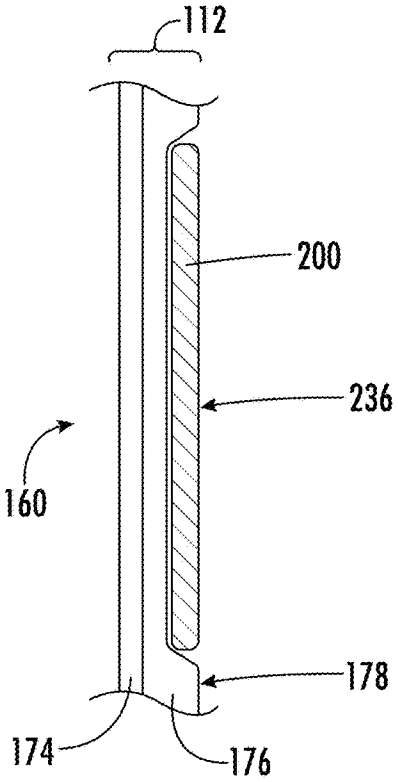
FIG. 5 is a partial cross-sectional view through the upper and support member along the line V-V of FIG. 4.

FIG. 5 illustrates a partial cross-sectional view of the heel region 160 of the upper 112. As shown in FIG. 5, the heel region 160 of the upper 112 in the illustrated embodiment is formed of two layers, an inner layer 174 and an outer layer 176. In some embodiments, the inner layer 174 is configured to provide cushioning and/or padding in certain regions of the shoe to increase comfort for the user. The outer layer 176 defines an outer surface 178, which forms a portion of the exterior surface of the shoe 100.

Figure 2:
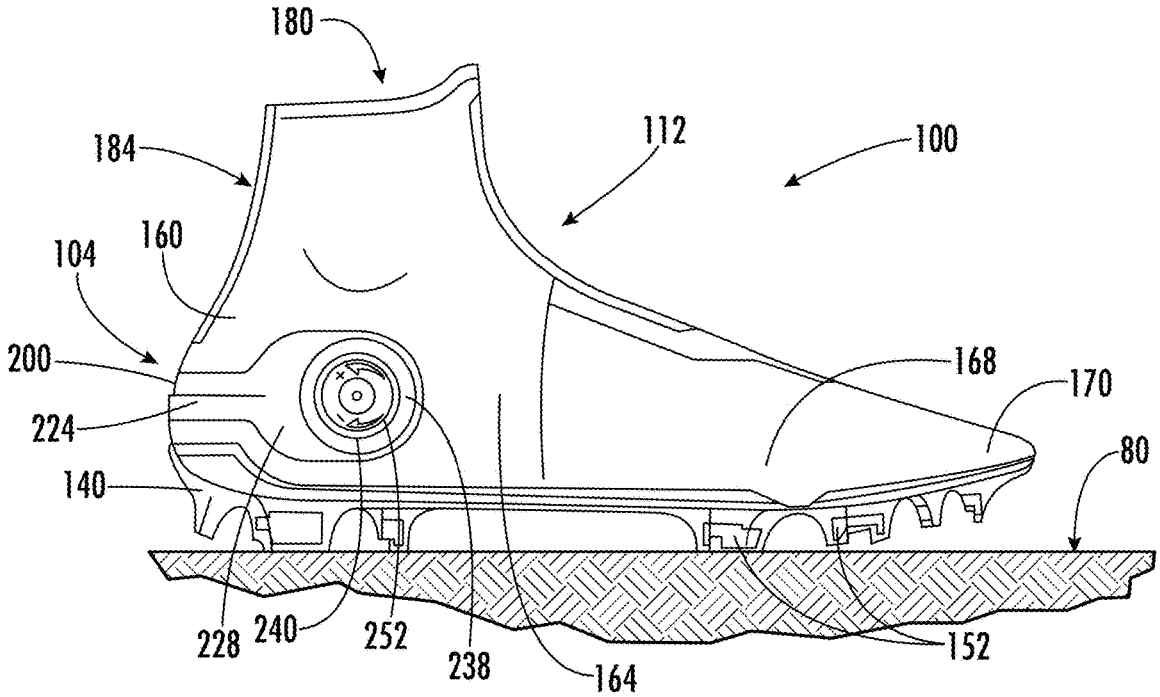
FIG. 2 is a lateral side view of the article of footwear of FIG. 1.
Figure 3:
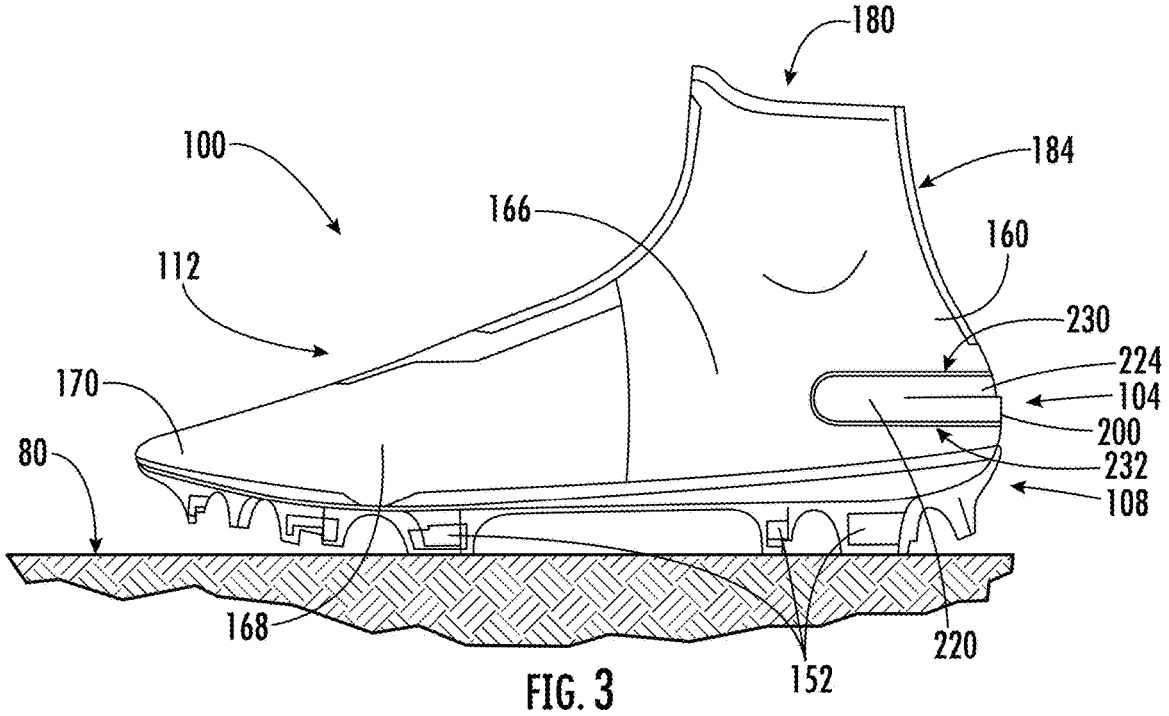
FIG. 3 is a medial side view of the article of footwear of FIG. 1.
Figure 4:
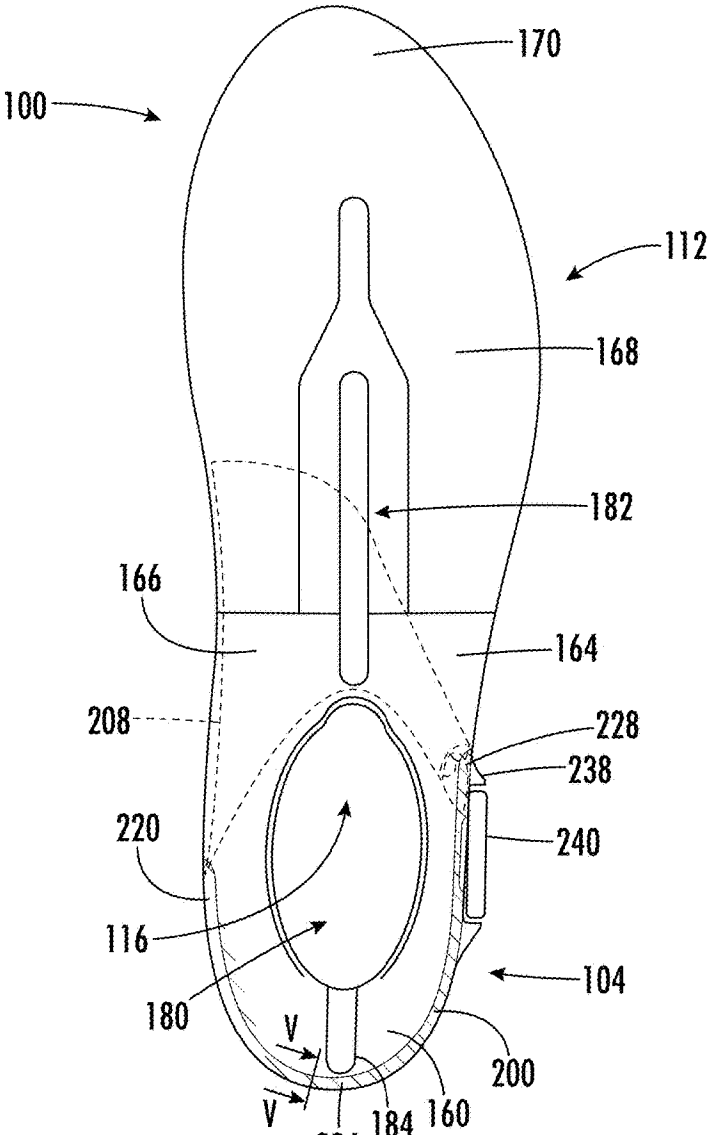
FIG. 4 is a top view of the article of footwear of FIG. 1.

Referring back to FIG. 1, with additional reference to FIGS. 2-4, the upper 112, along with the sole 108, defines the foot cavity 116 in the interior of the shoe 100. A top portion of the heel region 160 defines an access opening 180 that opens into the foot cavity 116. A throat 182 is defined forward of the access opening 180 between the lateral and medial quarter regions 164, 166 and extending into the vamp region 168. The throat 182 may be considered to be provided by a throat opening, and in some embodiments, a cover panel extends across the throat opening. In the embodiment illustrated in FIGS. 1-5, the heel region 160 of the upper 112 is separated along a line extending downwardly from the top of the heel region 160 at the access opening 180 so as form a gap 184. The upper 112 includes a zipper closure 188 configured to open the gap 184 to enable the user to insert and remove his or her foot from the foot cavity 116, and to close the gap 184 to retain the user's foot in the foot cavity 116. The reader should appreciate, however, that another suitable closure system can be used in place of the zipper closure 188, for example laces either at the rear of the shoe or in front of the ankle opening (see, for example, the embodiment of FIGS. 6-13), straps, clasps, resilient elastic material, and/or any other desired closure.

With continued reference to FIGS. 1-4, the harness system 104 of the shoe 100 is configured to secure the heel region of a user's foot against the shoe 100 so as to reduce or eliminate shifting of the heel region in the foot cavity 116. The harness system 104 includes a heel support member 200, an adjustment mechanism 204, and a securing strap 208, which, as discussed in detail below, interact with one another so as to clamp the heel region and central region of the user's foot in the shoe 100.

The heel support member 200 extends around the heel region 160 of the upper 112 from the medial side to the lateral side of the shoe 100. The heel support member 200 thus has a medial portion 220 and a rear portion 224, which together form an elongated portion of the heel support member 200, and a lateral portion 228, which forms a frame portion of the heel support member 200. The medial portion 220 and the rear portion 224 have the same height in the illustrated embodiment, though in other embodiments the height of the medial portion 220 is less than or greater than the height of the rear portion 224. In one embodiment, the height of the medial portion 220 is between 0.5 cm and 2.5 cm, while in other embodiments the height of the medial portion 220 is between 1.2 and 1.8 cm. In some embodiments, the height of the rear portion 224 is between 0.5 cm and 2.5 cm, while in other embodiments the height of the rear portion 224 is between 1.2 and 1.8 cm.

The thickness of the medial portion 220 and the rear portion 224, measured through a cross-section of the heel support member 200 (for example as shown in the cross-sectional cutaway view of FIG. 5) can be, for example, between 1 mm and 5 mm. In one embodiment, the thickness of the medial portion 220 and the rear portion 224 is between 2 mm and 3 mm.

The rear portion 224 of the heel support member 200 is arranged at a distance above the insole 148 such that the rear portion 224 is directly adjacent the user's calcaneus bone (heel bone). In some embodiments, however, the rear portion 224 is arranged so as to be adjacent to both the calcaneus bone and the Achilles tendon of the user, while in further embodiments the rear portion 224 is above the calcaneus bone and adjacent only to the user's Achilles tendon. In some embodiments, the middle of the rear portion 224 at the rearmost point of the shoe 100 is located between 0.7 and 3.0 cm above the insole 148, between 1.2 and 2.0 cm above the insole 148, or between 1.3 and 1.5 cm above the insole 148.

In one embodiment, the medial portion 220 and the rear portion 224 have a flat upper edge 230 extending in a first plane, and a flat lower edge 232 extending in a second plane. In some embodiments, the first and second planes of the flat upper and lower edges 230, 232, respectively, are substantially parallel to a plane defined by a flat surface 80 (FIGS. 2 and 3) on which the traction elements 152 of the shoe 100 rest in the absence of any external forces. As used herein, the term "substantially parallel" refers to a plane or line that is aligned with the reference plane or line to within ±10 degrees of parallel.

As illustrated in FIG. 5, in some embodiments, the outer surface 178 of the upper 112 and the outer surface 236 of the heel support member 200 are at least substantially flush. As used herein, the term "at least substantially flush" refers to surfaces, in this instance the outer surfaces 234, 236, which are in planes that are within 1 mm of being coincident with one another in the region at which the surfaces are adjacent to one another. While the embodiment illustrated in FIGS. 1-5 depicts the heel support member 200 on the exterior of the upper 112, in other embodiments the heel support member 200 is positioned inside the inner layer 174, between the inner and outer layers 174, 176, or within a portion of one or both of the inner and outer layers 174, 176.

Referring back to FIGS. 1 and 2, the lateral portion 228 of the heel support member 200 flares outwardly from the connection with the rear portion 224 such that the lateral portion 228 has a greater height than the rear portion 224. The height of the lateral portion 228 at the maximum extent can be, for example, between 2.5 cm and 5.0 cm. In another embodiment, the height of the lateral portion 228 is between 3.5 and 4.5 cm.

The lateral portion 228 further includes a tapering protrusion 238 that extends laterally outwardly from the main body of the lateral portion 228 of the heel support member 200. The protrusion 238 is generally circular The heel support member 200 is formed of a substantially rigid material or a rigid material. As used herein, the term "substantially rigid" refers to a material having a Young's modulus greater than or equal to 0.5 GPa, while the term "rigid" refers to a material having a Young's modulus of greater than or equal to 1.0 GPa. Examples of materials used for the heel support member 200 in various embodiments include, but are not limited to, substantially rigid or rigid thermoplastics such as polyvinylchloride ("PVC"), chlorinated PVC ("CPVC"), acrylonitrile butadiene styrene ("ABS").

As shown in FIGS. 1, 2, and 4, the adjustment mechanism 204 includes an actuator 240 and a cable 244. The actuator 240 is mounted in the lateral portion 228 of the heel support member 200 in such a way that the heel support member 200 supports the actuator 240. The actuator 240 204 can be, for example, welded to the heel support member 200, clamped between two layers of the heel support member 200, integrally formed with the heel support member 200, or otherwise positively connected to the heel support member 200. The actuator is circumferentially surrounded by at least a portion of the protrusion 238 of the lateral portion 228 of the heel support member 200. As a result, the inner radial portion of the protrusion 238, which is adjacent to the actuator 240 and extends away from the main body of the lateral portion 228, serves to deflect impacts to the shoe 100 away from the actuator 240.

While the illustrated embodiment shows the actuator 240 being mounted in the lateral portion 228 of the heel support member 200, the reader should appreciate that in other embodiments the actuator 240 is mounted in the rear portion 224 or the medial portion 220 of the heel support member 200. In some further embodiments, the actuator 240 is supported by the sole 108 of the shoe 100 or an extension thereof instead of being supported by the heel support member 200 (see, e.g., the embodiment of FIGS. 6-13 discussed below).

In the illustrated embodiment, the actuator 240 is configured as a reel mechanism similar to the reel mechanism described in U.S. Pat. No. 9,357,807, the contents of which are hereby incorporated by reference in their entirety. The actuator 240 includes a knob 252 in the form of a dial, which is configured to be manually rotated by a user. The cable 244 extends from the actuator 240 and connects to the securing strap 208. In the embodiment of FIGS. 1-5, the cable 244 is internal to the shoe 100, though in other embodiments, the cable 244 is partially external to the shoe 100 and passes through one or more holes in the upper 112 into the foot cavity 116. By way of example, the cable 244 is a steel wire, or a monofilament line formed of, e.g., nylon, polyvinylidene fluoride (PVDF), or ultra-high molecular weight polyethylene (UHMWPE).

The actuator 240 is configured such that, as the knob 252 is rotated in a first rotational direction, the cable 244 unwinds from a reel (not shown) inside the actuator 240, thereby increasing the effective length of the cable 244 (i.e. the length of the cable 244 outside the actuator 240). As the knob 252 is rotated in the opposite rotational direction, the cable 244 winds around the internal reel, thereby reducing the effective length of the cable 244.

In one embodiment, the actuator 240 further includes an internal ratchet mechanism (not shown) that has a pawl configured to lock into a series of detent indentations. The internal ratchet mechanism locks the knob 252 in position against accidental or unintended rotation, while being configured for the pawl to slide out of the detents when the knob 252 is rotated by the user. In some embodiments, the knob 252 may be configured to be moved axially inwardly and/or outwardly to lock and unlock rotational movement of the knob 252. In one embodiment, the actuator 240 includes an additional actuator mechanism, for example a lever or a button, which locks and/or unlocks rotational movement of the knob 252.

The securing strap 208 has an adjustable lateral side 260, a top side 264, and a fixed medial side 268. The securing strap 208 extends within the foot cavity 116 from the lateral quarter region 164, across the underside of the throat 182, to the medial quarter region 166. The lateral side 260 of the securing strap 208 includes two textile loops 272 through which the cable 244 passes so as to connect the cable 244 to the securing strap 208. The width of the lateral side 260 is between approximately 1.5 cm and 3.5 cm, with the width of the lateral side 260 being greater at the connection with the top side 264 than at the loops 272. In some embodiments, the width of the lateral side 260 adjacent to the loops 272 is between 10% and 20% of the overall length of the shoe 100.

Securing strap 208 increases in width from the lateral side 260 to the medial side 268, with the top side 264 having a greater width than the lateral side 260, and the medial side 268 having a greater width than the top side 264. In some embodiments, the width of the top side 264 has a width that is between 10% and 40% of the overall length of the shoe 100. In at least one particular embodiment, the securing strap 208 is tapered from about 10 cm on the medial side 268 to about 5 cm on the top side 264 and about 3 cm on the lateral side 260. As used herein, the term "about" includes lengths that are within +20% of the reference value. In some embodiments, the top side 264 passes through a pocket in a tongue of the shoe 100, while in other embodiments the top side passes through a pocket formed in the interior of the upper 112.

The medial side 268 of the securing strap 208 extends from the top side 264 and terminates at a lower portion of the upper 112 at or near the connection of the upper 112 and the sole 108. The medial side 268 includes a plurality of apertures 276 configured to enable airflow to pass through the securing strap 208 and provide breathability for the user's foot.

In some embodiments, the end of the medial side 268 of the securing strap 208 is stitched, glued, fused, or otherwise affixed to the upper 112. In other embodiments, the end of the medial side 268 is clamped, stitched, glued, fused, or otherwise affixed between the upper 112 and the sole 108, while in further embodiments, the end of the medial side 268 is stitched, glued, fused, or otherwise affixed to the sole 108. As illustrated, the medial side 268 is fixed while the lateral side 260 is adjustable, though the reader should appreciate that in other embodiments the lateral end may be fixed and the medial end may be adjustable.

At the location on the medial side 268 where the securing strap 208 connects to the upper 112 and/or the sole 108, the width of the securing strap 208 is greater than or equal to 25% of the overall length of the shoe 100 from the heel end to the toe end. In some embodiments, the width of the securing strap 208 at the connection with the upper 112 and/or the sole 108 is between 35% and 70% of the overall length of the shoe 100. In another embodiment, the width of the securing strap 208 at the connection with the upper 112 and/or the sole 108 is between 45% and 55% of the overall length of the shoe 100.

As can be seen particularly in FIG. 4, the harness system 104 substantially surrounds the access opening 180 and the ankle region of the user. As used herein, the harness system 104 substantially surrounding the access opening and the ankle region of the user means that the harness system 104 circumferentially surrounds at least 60% of the access opening when viewed from directly above the access opening. In some embodiments, the harness system 104 may circumferentially surround at least 75%, at least 85%, or at least 95% of the access opening when viewed from directly above the access opening (i.e. in the view of FIG. 4). In the embodiment of FIGS. 1-5, the harness system 104 completely surrounds the access opening 180 when viewed from above.

To use the shoe 100, a user inserts his or her foot through the access opening 180 and the gap 184. The user's foot passes through the securing strap 208 in such a way that the top side 264 is located approximately over the user's metatarsal and/or cuneiform bones. The user then closes the gap 184 by closing the zipper closure 188, thereby holding the user's foot in the shoe 100.

The user then manipulates the knob 252 of the actuator 240 to incrementally reduce the effective length of the cable 244. Since the cable 244 passes through the loops 272, as the effective length of the cable 244 is reduced, the cable 244 pulls the loops and thus the lateral side 260 of the securing strap 208 in a direction toward the actuator 240. The ratchet or locking mechanism of the actuator 240 retains the knob 252 of the actuator 240, and thus the effective length of the cable 244, at the desired position.

The securing strap 208, particularly the top side 264 and the medial side 268, then exerts a force on the user's foot acting in a direction toward the bottom of the shoe 100 (depicted in FIG. 1 by force vector 280) and toward the heel region 160 of the shoe 100 (depicted in FIG. 1 by force vector 284). Once the securing strap 208 is tightened via the actuator 240, the heel region of the user's foot is substantially encapsulated, and clamped, between the securing strap 208 and the heel support member 200 and sole 108. As such, relative movement between the user's heel and the heel region 160 of the shoe 100 is reduced or eliminated.

In a conventional shoe, the user's foot is retained in place only by laces that pull the medial and lateral sides of the upper together. The force exerted by laces in a conventional shoe therefore causes the shoe to tighten around the metatarsal region of the user's foot, thereby clamping the user's foot only to the center of the sole (i.e. in the middle between the heel region and the toe region of the shoe). The user's heel, however, is not held securely in the shoe, allowing the heel to move relative to the shoe.

Studies have shown that relative movement between the shoe and the user's foot reduces athletic performance, particularly for the user's top speed, agility, and braking or stopping. In particular, when a user slows or stops while running, the user's foot tends to slide forward in the shoe. When the user's foot slides forward, the user is unable to brake or stop as quickly as if the foot were prevented from sliding forward in the shoe. In addition, movement between the shoe and the user's foot can cause discomfort and irritation due to the heel rubbing against the upper or the sole.

In the shoe 100, the zipper closure 188 retains the foot in the shoe 100, and, in some embodiments, secures the ankle in the shoe 100. The harness system 104 secures the heel and middle region of the foot against movement relative to the shoe 100. Moreover, the medial side 268 of the securing strap 208 extends along a substantial length of the shoe 100, thereby enabling the securing strap 208 to exert a downward force 280 on not only the metatarsal region of the user's foot, but also on the region of the cuneiform bones in the foot.

In addition, the securing strap 208 exerts a rearward directed force on the user's foot in the region of the cuneiform bones. The rearward directed force 284 urges the user's foot such that the region of the user's calcaneus bone is pressed against the heel support member 200 in such a way that the securing strap 208 clamps the heel region of the user's foot between the securing strap 208 and the heel support member 200. The shoe 100 thereby limits the forward motion of the foot relative to the shoe 100.

Since the disclosed shoe 100 clamps not only the metatarsal region of the foot, but also the cuneiform bone region and the heel region of the foot, and since the shoe 100 clamps the heel region against the heel support member 200 at the back of the shoe 100, the shoe 100 according to the disclosure retains the user's foot more securely in the shoe 100 compared to a conventional shoe. As such, the user's foot moves less within the shoe 100, thereby enabling improved speed, agility, and braking or stopping of the user, as well as improving the comfort of the user wearing the shoe 100.

FIGS. 6-13 illustrate another embodiment of a shoe 300 having a harness system 304 configured to retain the user's heel region securely in the shoe 300. As in the embodiment described above, the harness system 304 is configured to secure the heel region of the user's foot in the shoe 300.

The shoe 300 includes a sole 308 and an upper 312, which jointly define a foot cavity 316. The sole 308 has an outsole 340, a midsole (not shown), and an insole 348. The midsole and the insole are both configured similarly to the embodiment of FIG. 1. In the illustrated embodiment, the outsole 340 is a plate formed of a rigid or substantially rigid plastic material, or other rigid or substantially rigid material, and includes a plurality of traction elements, or cleats, 352.

Figure 6:
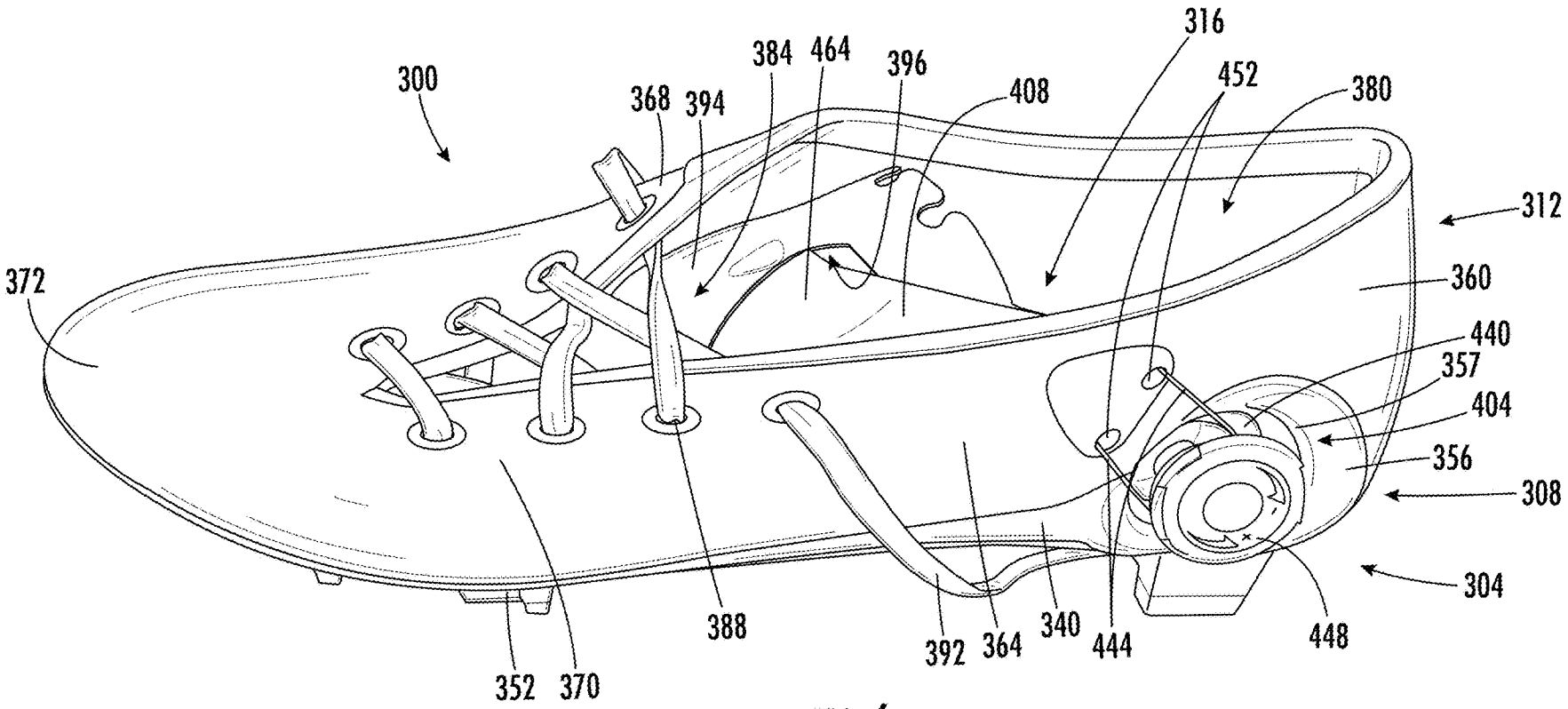
FIG. 6 is a lateral side perspective view of an article of footwear having a harness system.
Figure 7:
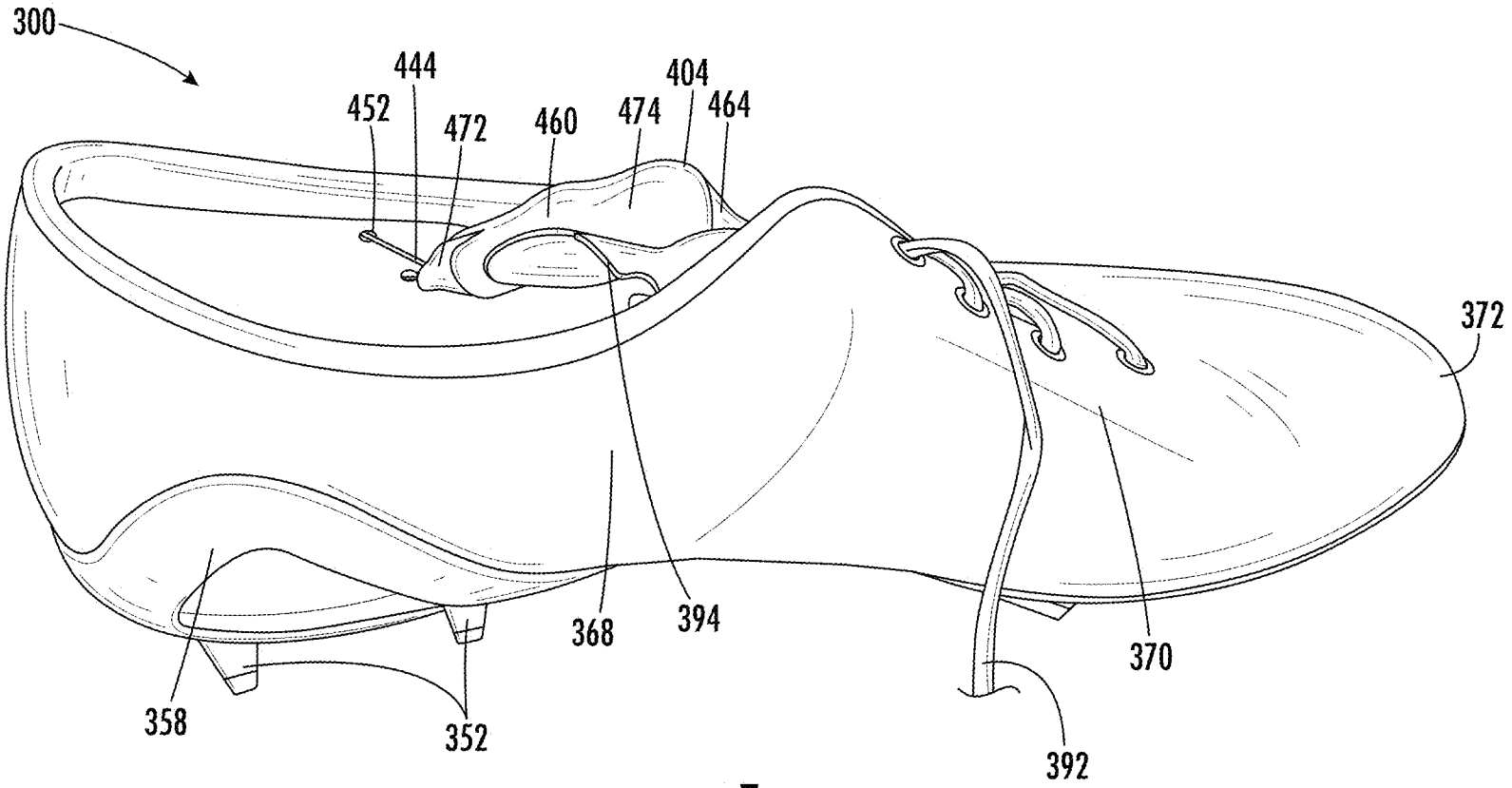
FIG. 7 is a medial side perspective view of the article of footwear of FIG. 6.
Figure 9:
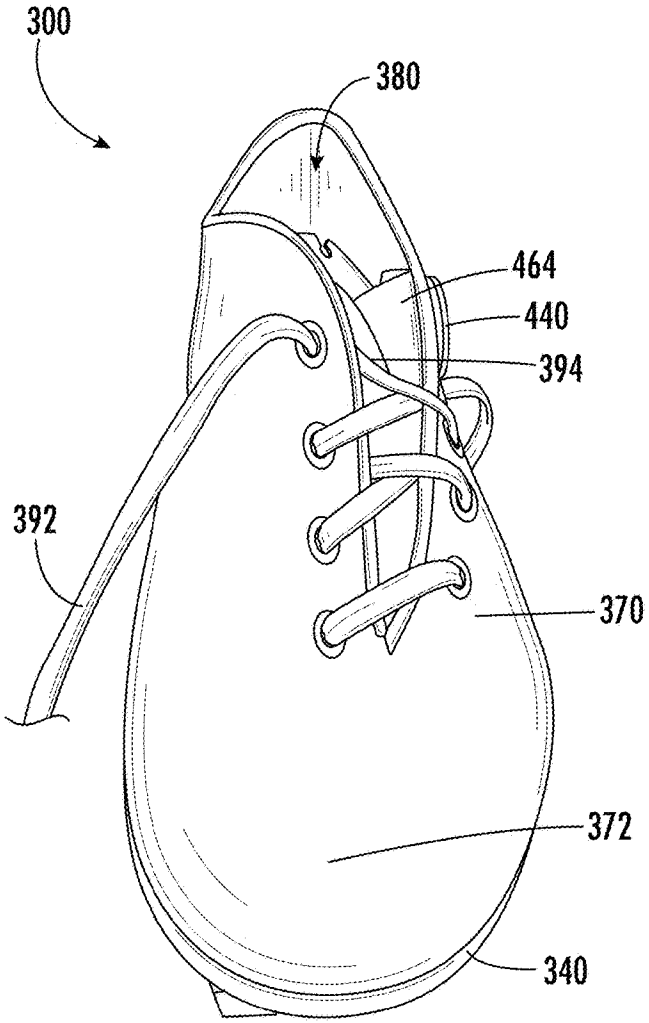
FIG. 9 is a front perspective view of the article of footwear of FIG. 6.
Figure 8:
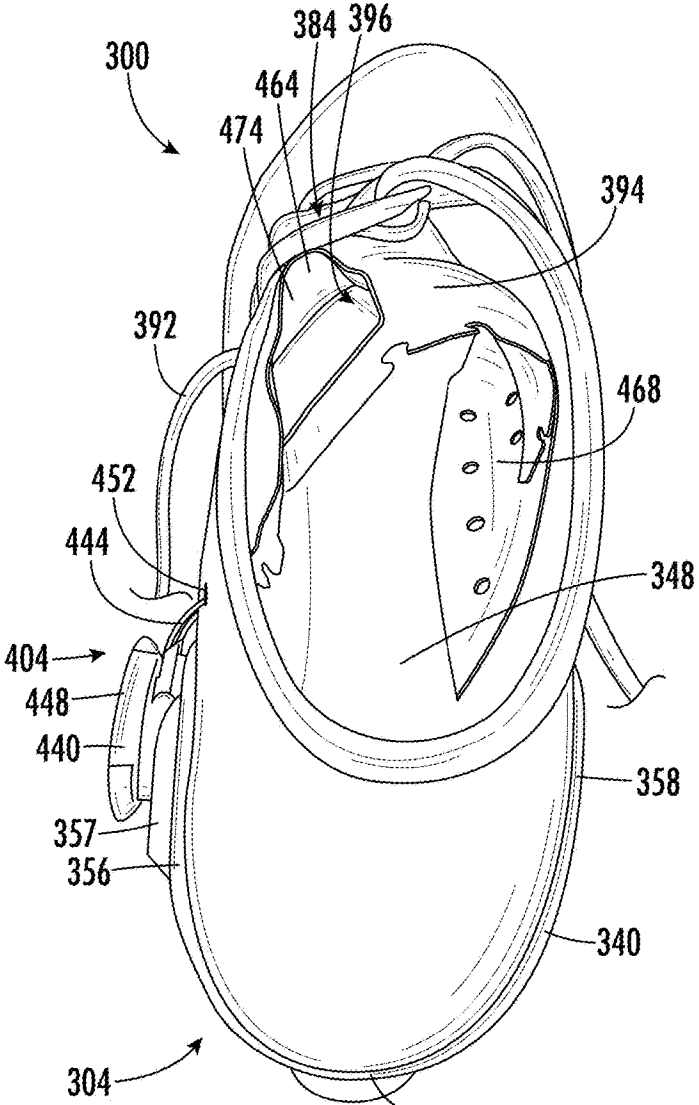
FIG. 8 is a rear perspective view of the article of footwear of FIG. 6.
Figure 10:
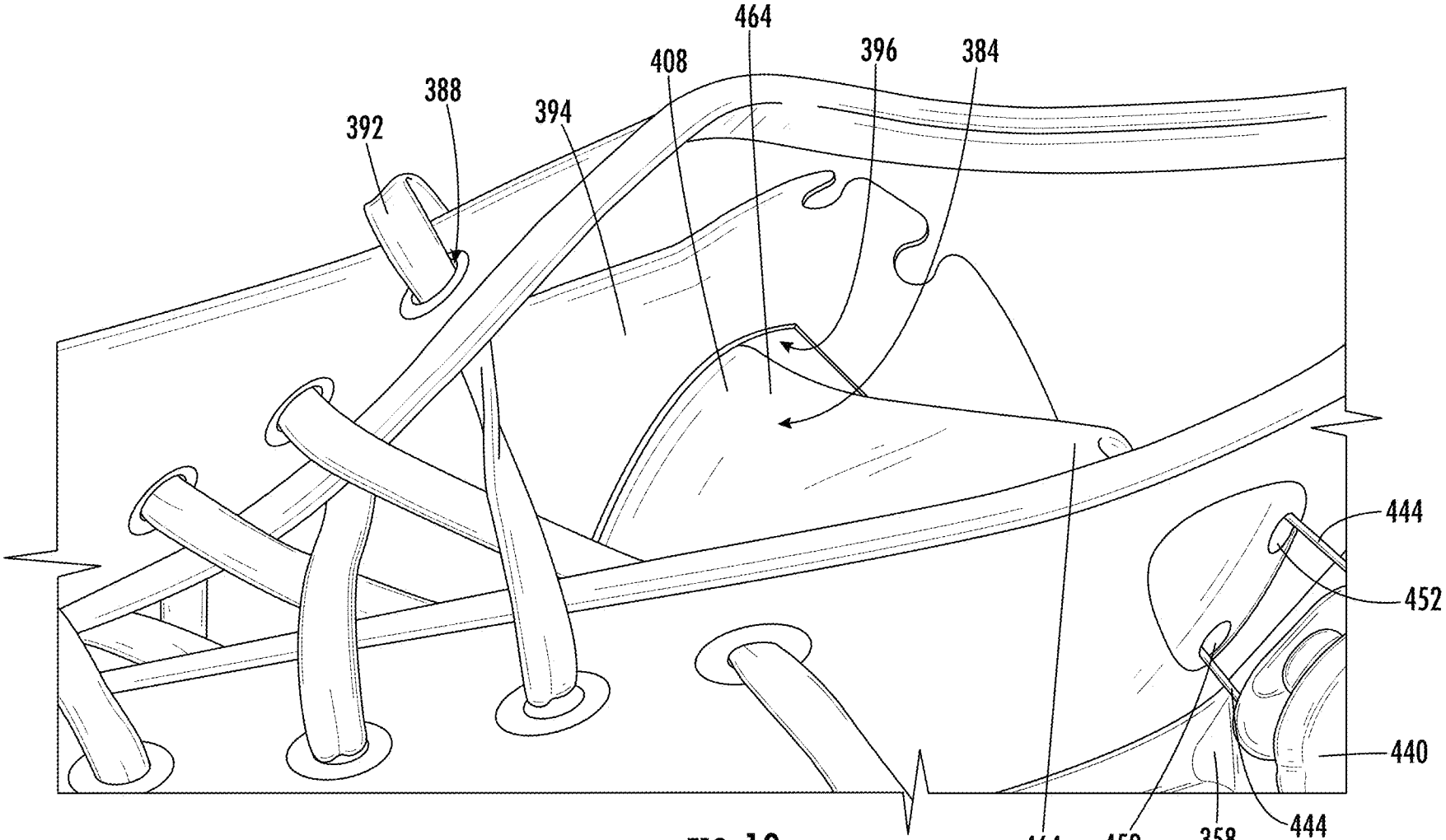
FIG. 10 is a detail view of the tongue and securing strap of the article of footwear of FIG. 6.
Figure 12:
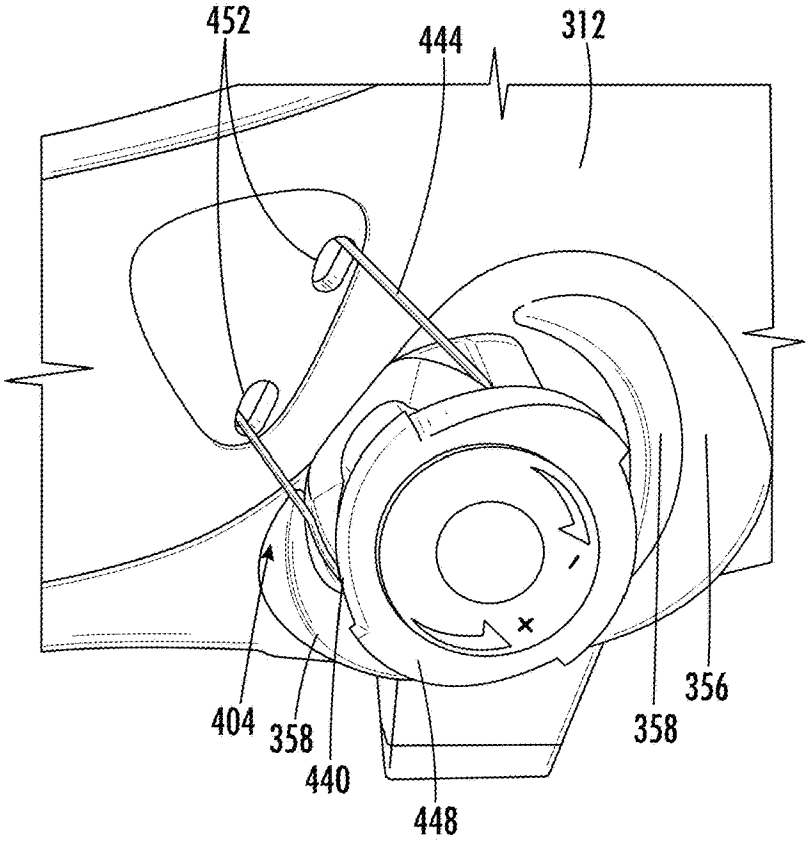
FIG. 12 is a detail view of the actuator of the article of footwear of FIG. 6.
Figure 14A:
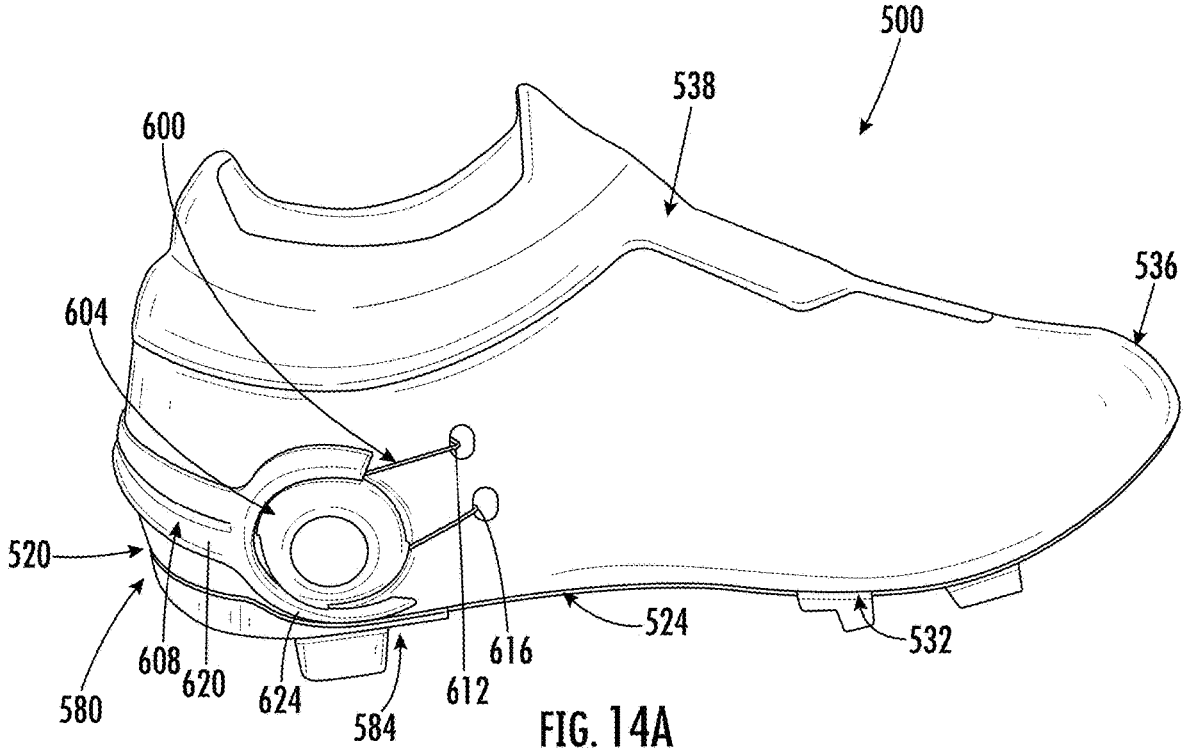
FIG. 14A is a lateral side view of an article of footwear in accordance with an embodiment of the disclosure.
Figure 14B:
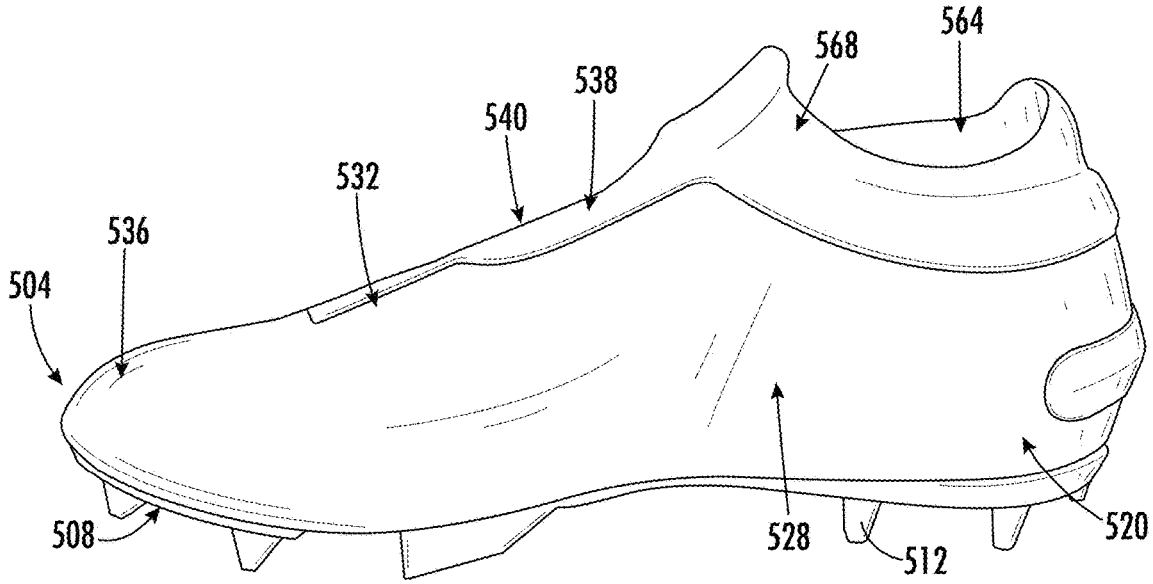
FIG. 14B is a medial side view of the article of footwear of FIG. 14A.
Figure 14C:
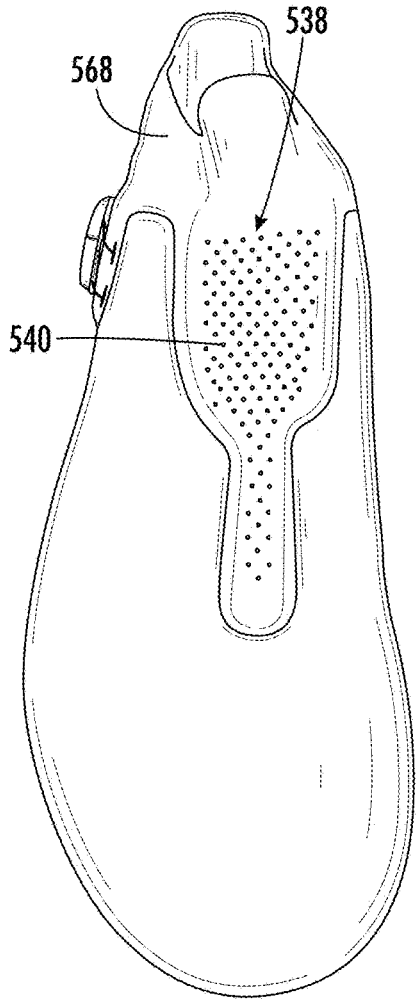
FIG. 14C is a top view of the article of footwear of FIG. 14A.
Figure 14D:
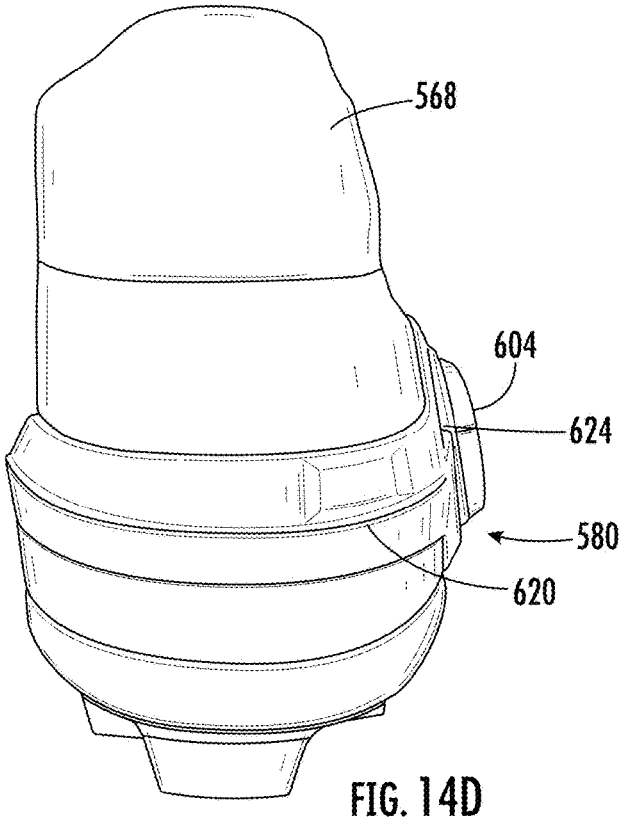
FIG. 14D is a rear view of the article of footwear of FIG. 14A.

As best illustrated in FIGS. 6, 8, and 12, the lateral side of the outsole 340 includes a mounting region 356 that extends over a portion of the upper 312 substantially vertically from the substantially horizontal bottom plate on the of the article of footwear 300 near the heel. The mounting region 356 is formed integrally and unitarily with the rest of the outsole 340, and, as discussed in detail below, supports the actuator 440. The mounting region 356 also includes a protrusion 357 circumferentially surrounding at least a portion of the actuator 440 and formed such that the protrusion 357 laterally protrudes from the outsole 340 adjacent to the actuator 440 so as to deflect impacts away from the actuator 440.

On the medial side of the outsole 340, opposite the mounting region 356, the outsole 340 includes an extension portion 358 extending substantially vertically from the substantially horizontal bottom plate portion over a portion of the upper 312. The mounting region 356, extension portion 358, and the heel portion 359 of the outsole 340 connecting the mounting region 356 to the extension portion 358 jointly define a support member that extends around the underside of the heel region of the article of footwear 300 from the medial side to the lateral side. The entire support member is therefore integral and unitarily formed with the outsole 340. While the support member is illustrated as being formed integrally with the outsole 340, the reader should appreciate that in some embodiments the article of footwear 300 may include a heel support member similar to the heel support member described above in the embodiment of FIGS. 1-5.

With reference to FIGS. 6-9, the upper 312 includes a heel region 360, a lateral quarter region 364, a medial quarter region 368, a vamp region 370, and a toe cage region 372. In some embodiments, the upper 312 is formed of a continuous single layer or multilayer material. In other embodiments, different regions of the upper 312 are formed of different single layer or multilayer materials. For example in one embodiment, the toe cage region 372, the vamp region 370, and a portion of the lateral and medial quarter regions 364, 368 are formed of one material, while the heel region 360 and the remaining portion of the lateral and medial quarter regions 364, 368 are formed of a different material.

The upper 312 and the sole 308 jointly define the foot cavity 316 in the interior of the shoe 300. A top portion of the heel region 360 defines an access opening 380, which opens into the foot cavity 316. The access opening 380 connects to a throat opening 384, which is defined between the lateral quarter region 364 and the medial quarter region 368 of the upper 312 and terminates in the vamp region 370. A plurality of lace eyelets 388 are defined in the upper 312 on each side of the throat opening 384. A lace 392 extends through the lace eyelets 388 so as to enable a user to tie the shoe 300 to retain the shoe on the user's foot. In the illustrated embodiment, each of the lateral side and the medial side has four lace eyelets 388, though more or less lace openings are used in other embodiments. In some embodiments, the shoe includes a different closure mechanism, for example a zipper, a closure strap, a resilient elastic material, or another desired closure mechanism.

The shoe 300 further includes a tongue 394 located in the foot cavity 316 underneath the throat opening 384 and configured to be positioned between the throat opening 384 and the user's foot when the user is wearing the shoe 300. The tongue 394 is stitched, fused, or otherwise affixed to the underside of the toe cage region 372 of the upper 312 such that the tongue 394 is tethered to the toe cage region 372. The tongue 394 includes a tongue pocket 396 extending through a portion of the tongue 394. In some embodiments, the tongue 394 includes a one or more padded regions 398 (FIG. 11) on the bottom side of the tongue 394 to cushion the pressure of the tongue 394 on the user's foot.

With reference to FIG. 6, the harness system 304 includes an adjustment mechanism 404 and a securing strap 408. Similarly to the embodiment discussed above with reference to FIGS. 1-5, the harness system 304 of the embodiment of FIGS. 6-13 is configured such that the adjustment mechanism 404 and securing strap 408 interact with one another to secure the heel region of a user's foot against the shoe 300 so as to reduce or eliminate shifting of the heel region in the foot cavity 316.

The adjustment mechanism 404 includes the actuator 440 and a cable 444. As best illustrated in the detail views of FIGS. 10 and 12, the actuator 440 is positively affixed to the mounting region 356 of the outsole 340 by, for example, being welded to the outsole 340, clamped to the outsole 340, integrally formed with the outsole 340, or by another suitable attachment method. The actuator 440 has a knob 448, which is configured to be manually rotated by a user.

The cable 444 extends from the actuator 440, through two holes 452 defined in the lateral quarter region 364 of the upper 312, and connects to the securing strap 408 in the foot cavity 316. By way of example, the cable 444 is a steel wire, or a monofilament line formed of, e.g., nylon, polyvinylidene fluoride (PVDF), or ultra-high molecular weight polyethylene (UHMWPE).

As in the embodiment described above, the actuator 440 is configured as a reel mechanism. As the knob 448 is rotated in a first rotational direction, the cable 444 unwinds from a reel (not shown) inside the actuator 440, thereby increasing the effective length of the cable 444 outside the actuator 440. As the knob 448 is rotated in the opposite rotational direction, the cable 444 winds around the internal reel, thereby reducing the effective length of the cable 444.

Figure 13:
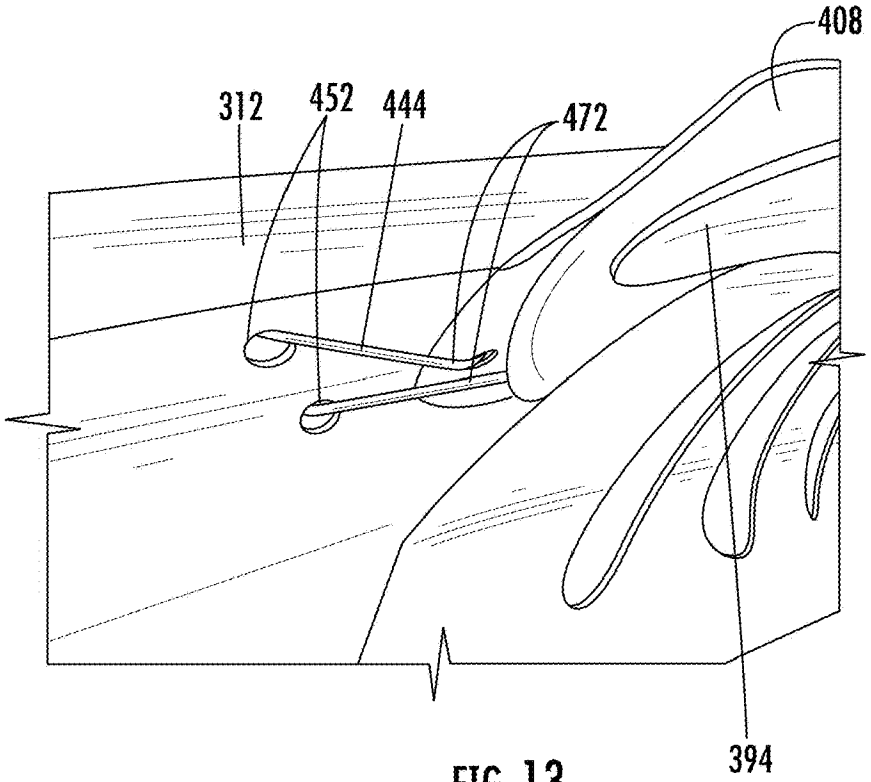
FIG. 13 is a detail view of the cable and loops of the article of footwear of FIG. 6.

Referring now to FIGS. 8, 10, 11, and 13, the securing strap 408 has an adjustable lateral side 460, a top side 464, and a fixed medial side 468. The securing strap 408 extends from the medial side of the upper 312, across the underside of the throat opening 384, and to the lateral side of the upper 312. As shown in FIG. 13, the lateral side 460 includes two textile loops 472 through which the cable 444 passes so as to connect the cable 444 to the securing strap 408. As illustrated, the medial side 460 is fixed while the lateral side 468 is adjustable, though the reader should appreciate that in other embodiments the lateral side may be fixed and the medial side may be adjustable.

In the embodiment illustrated in FIGS. 6-13, the lateral side 460 of the securing strap 408 has a constant width of between approximately 2.0 cm and 4.0 cm. The top side 464 of the securing strap 408 has an essentially constant width from the lateral side 460 to the medial side 468, and the width of the top side 464 is substantially equal to the width of the lateral side 460. The top side 464 passes through the pocket 396 in the tongue 394 of the shoe 300. In some embodiments, at least a portion of the bottom of the top side 464 includes a low-friction material 474, for example, a synthetic polymer such as nylon, which enables the securing strap 408 to slide relative to the tongue 394.

Figure 11:
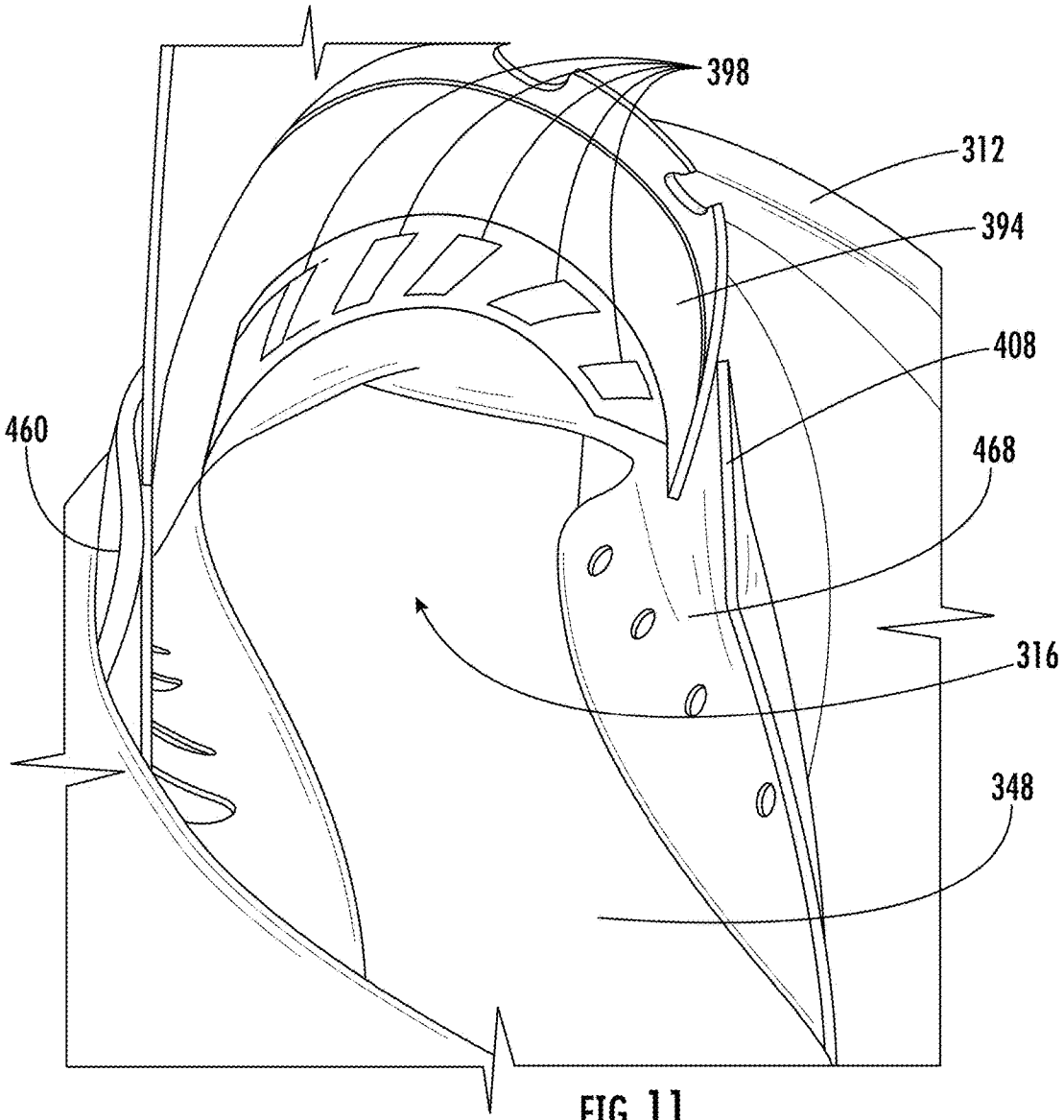
FIG. 11 is a detail view inside the foot cavity of the article of footwear of FIG. 6, showing the tongue and securing strap.

Referring now to FIGS. 8 and 11, the medial side 468 of the securing strap 408 extends from the top side 464 and terminates at a lower portion of the upper 312 at or near the connection of the upper 312 and the sole 308. The medial side 468 includes a plurality of apertures 476 configured to enable air to pass through the securing strap 408 and provide breathability for the user's foot.

In some embodiments, the end of the medial side 468 of the securing strap 408 is stitched, glued, fused, or otherwise affixed to the upper 312. In other embodiments, the end of the medial side 468 is clamped, stitched, glued, fused, or otherwise affixed between the upper 312 and the sole 308, while in further embodiments, the end of the medial side 468 is stitched, glued, fused, or otherwise affixed to the sole 308.

The medial side 468 increases in width from the top side 464 to a connection with the upper 312 and/or the sole 308. At the location where the securing strap 408 connects to the upper 312 and/or the sole 308, the width of the securing strap 408 is greater than or equal to 25% of the overall length of the shoe 300 from the heel end to the toe end. In some embodiments, the width of the securing strap 408 measured along the length of the shoe 300 at the connection with the upper 312 and/or the sole 308 is between 35% and 70% of the overall length of the shoe 300. In another embodiment, the width of the securing strap 408 at the connection with the upper 312 and/or the sole 308 is between 45% and 55% of the length of the shoe 300.

To use the shoe 300, a user inserts his or her foot through the access opening 380 and into the foot cavity 316. The user's foot passes through the securing strap 408 in such a way that the top side 464 is located approximately over the user's metatarsal and/or cuneiform bones. The user then ties the lace 392, thereby holding the user's foot in the shoe 300.

Next, the user turns the knob 448 of the actuator 440 in the direction that reduces the effective length of the cable 444. Since the cable 444 passes through the loops 472, as the effective length of the cable 444 is reduced, the cable 444 pulls the loops, and thus the lateral side 460 of the securing strap 408, in a direction toward the actuator 440. The securing strap 408, particularly the top side 464 and the medial side 468, then exerts a force on the user's foot acting in a direction toward the heel region 360 of the shoe 300. Once the securing strap 408 is tightened via the actuator 440, the heel region of the user's foot is encapsulated, and clamped, between the heel region 360 of the upper 312 and the securing strap 408. As such, since the foot is clamped by the harness system 304, relative movement between the user's heel and the heel region 360 of the shoe is reduced or eliminated, thereby supplementing the downward clamping provided by the laces 392.

FIGS. 14A-14D, 15A-15B, and 16 illustrate another embodiment of the article of footwear. As shown, the article of footwear 500 is stylized as a global football (soccer) cleat, including an upper 504 and a plate 508 with traction elements (e.g. cleats) 512. As with the other embodiments described above, the article of footwear 500 defines a forefoot region, a midfoot region, and a hindfoot region, as well as a medial side and a lateral side. The forefoot region generally aligns with the ball and toes of the foot, the midfoot region generally aligns with the arch and instep areas of the foot, and the hindfoot region generally aligns with the heel and ankle areas of the foot. Additionally, the medial side is oriented along the medial (big toe) side of the foot, while the lateral side is oriented along the lateral (little toe) side of the foot.

The upper 504 includes and/or defines a plurality of sections that cooperate to define the foot cavity. A heel region 520 includes heel cup configured to align with and cover the calcaneus area of a human foot. A lateral quarter region 524, disposed forward the heel region 520, is oriented on the lateral shoe side. Similarly, a medial quarter region 528, disposed forward the heel region 520, is oriented on the medial shoe side. A vamp region 532 is disposed forward the quarter regions 524, 528, and a toe cage region 536 is disposed forward the vamp region 532. The upper 504 defines a throat 538 between the lateral and medial quarter regions 524, 528, and the throat 538 may be considered to include a throat opening that is covered by an instep cover region 540. The instep cover region 540 is configured to align with the central portion of the instep area of the foot and a planum section such as a strobel and/or insole underfoot forming a footbed. With this configuration, the heel, lateral quarter, medial quarter, vamp, and toe cage regions cooperate with the plate, strobel, and/or sockliner to define a foot cavity 560 into which a human foot is inserted by way of an access opening 564 that is defined by a collar 568.

In the illustrated embodiment, the instep cover region 540 and the collar 568 are formed of a knit textile structure of unitary construction (e.g., a monolithic or unibody construction). Knitting is a process for constructing fabric by interlocking a series of loops (bights) of one or more strands organized in wales and courses. In general, knitting includes warp knitting and weft knitting. In warp knitting, a plurality of strands runs lengthwise in the fabric to make all the loops. In weft knitting, one continuous strand runs crosswise in the fabric, making all of the loops in one course. Weft knitting includes fabrics formed on both circular knitting and flat knitting machines. With circular knitting machines, the fabric is produced in the form of a tube, with the strands running continuously around the fabric. With a flat knitting machine, the fabric is produced in flat form, the strands/loops alternating back and forth across the fabric. In an embodiment, the instep cover section and collar are formed via flat knitting utilizing stitches including, but not limited to, a plain stitch; a rib stitch, a purl stitch; a missed or float stitch (to produce a float of yarn on the fabric's wrong side); and a tuck stitch (to create an open space in the fabric). The resulting textile includes an interior side (the technical back) and an exterior side (the technical face), each layer being formed of the same or varying strands and/or stitches. By way of example, the textile may be a single knit/jersey fabric, a double knit/jersey fabric, and/or a plated fabric (with yarns of different properties are disposed on the face and back). In a specific embodiment, the textile is a double knit fabric formed via a flat knitting process. An exemplary knitting capable of forming the instep cover section and the collar includes the CMS 730 S or the CMS 530 H, both available from H. Stoll GmbH & Co. KG, Stollweg 1, Reutlingen, DE.

The strands forming the knitted textile (and thus the instep cover region 540 and collar 568) may be any natural or synthetic strands suitable for their described purpose (i.e., to form a knit upper). The term "strand" includes one or more filaments organized into a fiber and/or an ordered assemblage of textile fibers having a high ratio of length to diameter and normally used as a unit (e.g., slivers, roving, single yarns, plies yarns, cords, braids, ropes, etc.). In a preferred embodiment, a strand is a yarn, i.e., a continuous strand of textile fibers, filaments, or material in a form suitable for knitting, weaving, or otherwise intertwining to form a textile fabric. A yarn may include a number of fibers twisted together (spun yarn); a number of filaments laid together without twist (a zero-twist yarn); a number of filaments laid together with a degree of twist; and a single filament with or without twist (a monofilament).

The strands may be heat sensitive strands such as flowable (fusible) strands and softening strands. Flowable strands are include polymers that possess a melting and/or glass transition point at which the solid polymer liquefies, generating viscous flow (i.e., becomes molten). In an embodiment, the melting and/or glass transition point of the flowable polymer may be approximately 80° C. to about 150° C. (e.g., 85° C.). Examples of flowable strands include thermoplastic materials such as polyurethanes (i.e., thermoplastic polyurethane or TPU), ethylene vinyl acetates, polyamides (e.g., low melt nylons), and polyesters (e.g., low melt polyester). Preferred examples of melting strands include TPU and polyester. As a strand becomes flowable, it surrounds adjacent strands. Upon cooling, the strands form a rigid interconnected structure that strengthens the textile and/or limits the movement of adjacent strands.

Softening strands are polymeric strands that possess a softening point (the temperature at which a material softens beyond some arbitrary softness). Many thermoplastic polymers do not have a defined point that marks the transition from solid to fluid. Instead, they become softer as temperature increases. The softening point is measured via the Vicat method (ISO 306 and ASTM D 1525), or via heat deflection test (HDT) (ISO 75 and ASTM D 648). In an embodiment, the softening point of the strand is from approximately 60° C. to approximately 90° C. When softened, the strands become tacky, adhering to adjacent stands. Once cooled, movement of the textile strands is restricted (i.e., the textile at that location stiffens).

One additional type of heat sensitive strand which may be utilized is a thermosetting strand. Thermosetting strands are generally flexible under ambient conditions, but become irreversibly inflexible upon heating.

The strands may also include heat insensitive strands. Heat insensitive strands are not sensitive to the processing temperatures experienced by the upper (e.g., during formation and/or use). Accordingly, heat insensitive strands possess a softening, glass transition, or melting point value greater than that of any softening or melting strands present in the textile structure and/or greater than the temperature ranges specified above.

The strand further includes elastic strands and inelastic strands. Elastic strands are strands formed of elastomeric material. Elastic strands, by virtue of their composition alone, are capable of stretching under stress and recovery to its original size once the stress is released. Accordingly, elastic strands are utilized to provide a textile upper with stretch properties. An elastic strand is formed rubber or a synthetic polymer having properties of rubber. A specific example of an elastomeric material suitable for forming an elastic strand is an elastomeric polyester-polyurethane copolymer such as elastane, which is a manufactured fiber in which the fiber-forming substance is a long chain synthetic polymer composed of at least 85% of segmented polyurethane.

In contrast, an inelastic strand is formed of a non-elastomeric material. Accordingly, inelastic strands possess no inherent stretch and/or recovery properties by virtue of composition. Hard yarns are examples of inelastic strands. Hard yarns include natural and/or synthetic spun staple yarns, natural and/or synthetic continuous filament yarns, and/or combinations thereof. By way of specific example, natural fibers include cellulosic fibers (e.g., cotton, bamboo) and protein fibers (e.g., wool, silk, and soybean). Synthetic fibers include polyester fibers (poly(ethylene terephthalate) fibers and poly(trimethylene terephthalate) fibers), polycaprolactam fibers, poly(hexamethylene adipamide) fibers, acrylic fibers, acetate fibers, rayon fibers, nylon fibers and combinations thereof.

The knit construction of the instep area and collar are configured to provide areas of the upper with resilient stretch, enabling the user to don and doff the shoe, as well as accommodating expansion during use. The remaining body of the upper 504 (the non-knit areas) are generally formed of materials lacking resilient stretch. By way of example, the non-knit areas of the upper may be forming of a film or membrane such as leather.

The article of footwear further includes a harness system 580 operable to minimize or prevent translational movement of the foot along the surface of the footbed during use. During game play, a player (e.g., a soccer player) engages in repeated acceleration, deceleration, and directional changes. During these actions, the foot shifts within the foot cavity, sliding along the surface of the footbed (e.g., the sockliner or insole). This sliding not only contributes to slowing the athlete down, but also increases the risk of injury from the toes of the foot repeatedly contacting the toe cage 536.

Figure 15A:
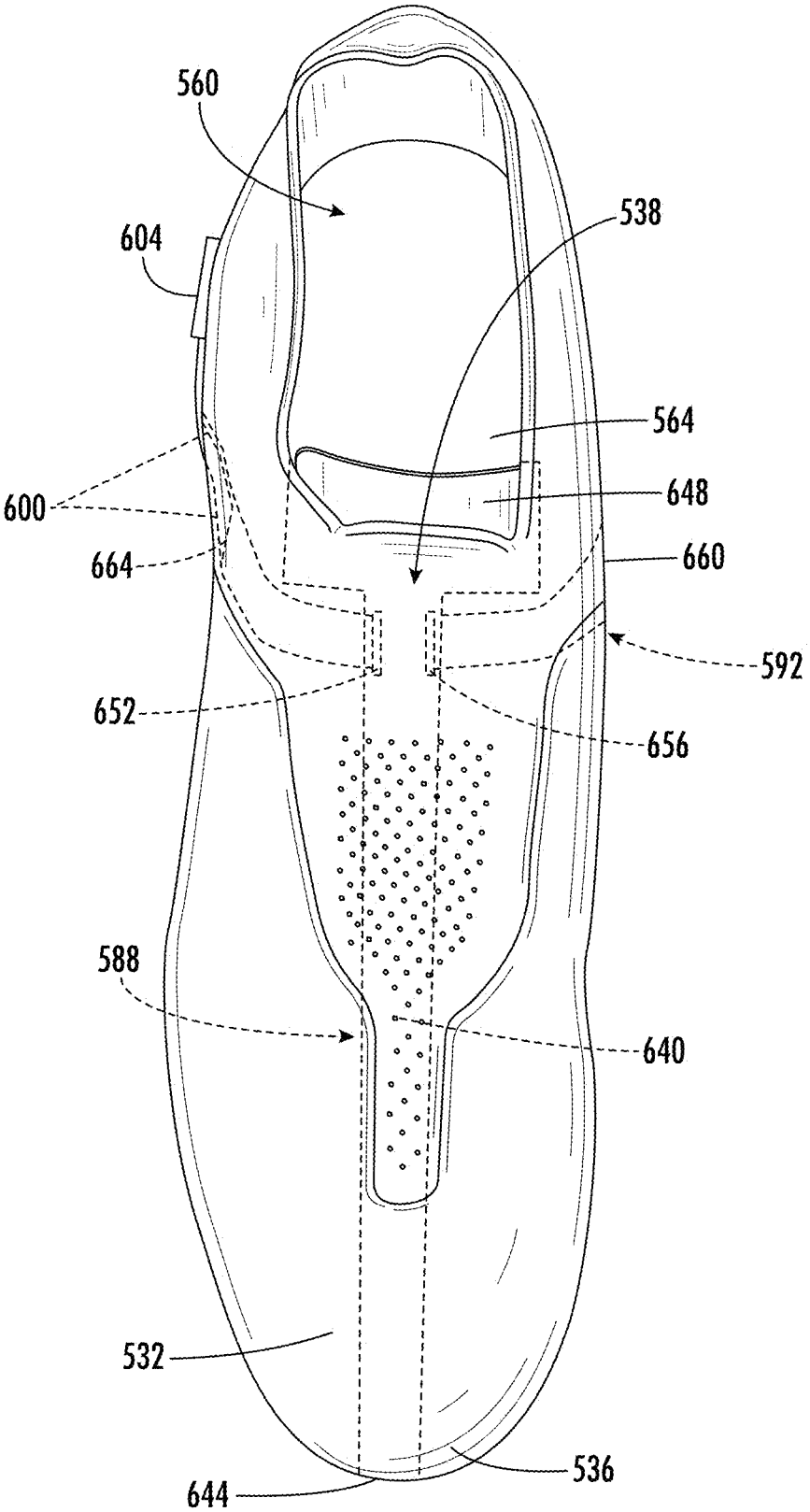
FIG. 15A is a top view of the article of footwear of FIG. 14A showing a harness system in accordance with an embodiment of the disclosure.

As best seen in FIG. 15A, the harness system 580 includes a tethered member 588 and a securing strap 592. The tethered member 588, oriented along the longitudinal axis of the article of footwear 500, extends from the toe cage 536 to the access opening 564. As shown, the tethered member 588 includes a narrowed proximal portion 640 defining a proximal end 644 that is fixed to the forward edge of the toe cage 536 (e.g., secured to the upper, strobel, etc.) and a widened distal portion 648 oriented forward the access opening 564.

The proximal portion 640 includes laterally spaced, aligned slots 652, 656 disposed forward of the distal portion 648.

The securing strap 592 extends along the transverse dimension of the upper (along the width of the article of footwear), extending from the medial footwear side, across the underside of the throat 538 (i.e., under the instep cover region 540), through the slots 652, 656, and toward the lateral footwear side. The securing strap defines a fixed medial end 660 and an adjustable lateral end 664. The medial end 660 is fixed to the article of footwear (e.g., stitched to strobel and/or upper) proximate the cleat plate 508. The lateral end 664 of the securing strap is coupled to the adjustment mechanism (described in greater detail below). As illustrated, the ends 660, 664 may be generally opposed, being positioned on opposite sides of the ankle. As illustrated, the medial end 660 is fixed while the lateral end 664 is adjustable, though the reader should appreciate that in other embodiments the lateral end may be fixed and the medial end may be adjustable.

In operation, the securing strap 592 is coupled to the tethered member 588. Specifically, the securing strap 592 is threaded through each slot 652, 656. Accordingly, the slots 652, 656 direct the travel path of the securing strap 592 across the foot cavity 560, as well as secure the position of the strap 592 within the foot cavity 560.

The harness system 580 further includes an adjustment mechanism 584, which includes a cable 600 coupled to the securing strap 592, and an actuator 604 operable to control the cable 600. The cable 600 is filament or wire having sufficient tensile strength to withstand forces placed thereon. By way of example, the cable 600 is a steel wire, or a monofilament line formed of, e.g., nylon, polyvinylidene fluoride (PVDF), or ultra-high molecular weight polyethylene (UHMWPE). As shown, the cable begins exterior to the upper 504, passing through the upper 504 via an upper port 612 and a lower port 616. The cable 600 is coupled (e.g., connected) to the securing strap 592 in any suitable manner. In a preferred embodiment, a channel is formed into the securing strap 592 proximate the medial end and aligned with the transverse dimension, with the cable 600 passing through the channel.

Similar to the embodiments discussed above with reference to FIGS. 1-13, the actuator 604 is configured to selectively increase and decrease the length of cable 600 extending out from the actuator 604. By way of example, the actuator 604 may be a reel mechanism similar to the reel mechanisms described above. The actuator 604 may be configured such that, as the actuator 604 is rotated in a first rotational direction, the cable 600 unwinds from a reel (not shown) inside the actuator 604, thereby increasing the effective length of the cable 600 (i.e. the length of the cable 600 outside the actuator 604). As the actuator 604 is rotated in the opposite rotational direction, the cable 600 winds around the internal reel, thereby reducing the effective length of the cable 600.

In one embodiment, the actuator 604 further includes an internal ratchet mechanism (not shown) that has a pawl configured to lock into a series of detent indentations. The internal ratchet mechanism locks the actuator 604 in position against accidental or unintended rotation, while being configured for the pawl to slide out of the detents when the actuator 604 is rotated by the user. In some embodiments, the actuator 604 may be configured to be moved axially inwardly and/or outwardly to lock and unlock rotational movement of the actuator 604. In one embodiment, the actuator 604 includes an additional actuator mechanism, for example a lever or a button, which locks and/or unlocks rotational movement of the actuator 604.

The harness system 580 also includes a heel support member 608 positioned along the exterior of the upper 504 proximate heel region. In some embodiments, the heel support member 608 may be similar or identical to the heel support member 200 discussed above with reference to the embodiment of FIGS. 1-5. The heel support member 608 is configured to dampen torsional stress experience by the upper during use. As shown, the heel support member 608 includes an elongated portion 620 beginning within the heel section on the medial shoe side and extending rearward, across the heel, and to the lateral shoe side. The heel support member 608 further includes a semi-circular frame portion 624 along the lateral shoe side that surrounds the base of the actuator 604. The heel support member 608 may be formed of a substantially rigid, resilient material such as thermoplastic polyurethane, polyurethane, nylon, etc.

Figure 15B:
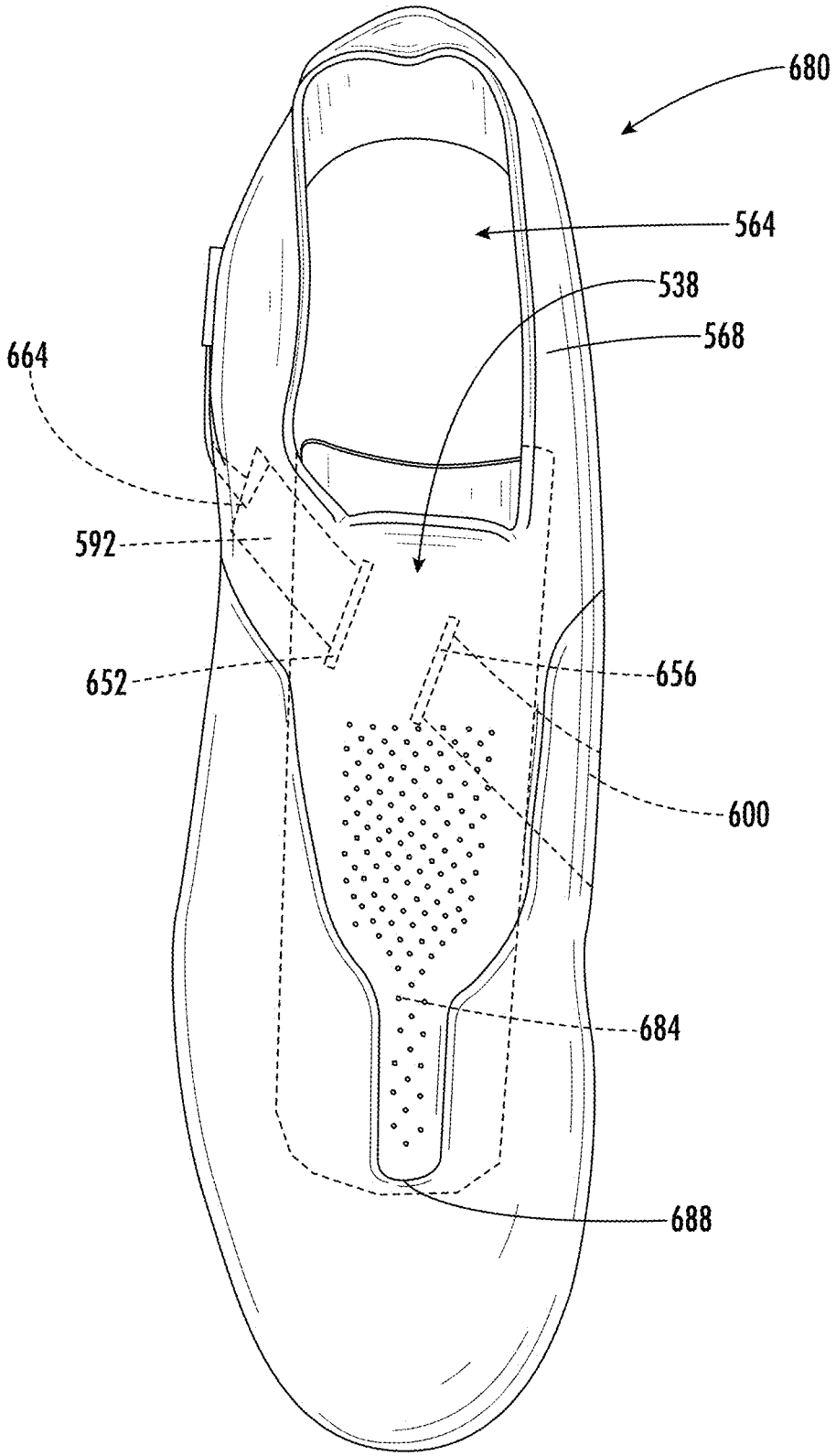
FIG. 15B is a top view of the article of footwear of FIG. 14A showing a harness system in accordance with an embodiment of the disclosure.
Figure 16:
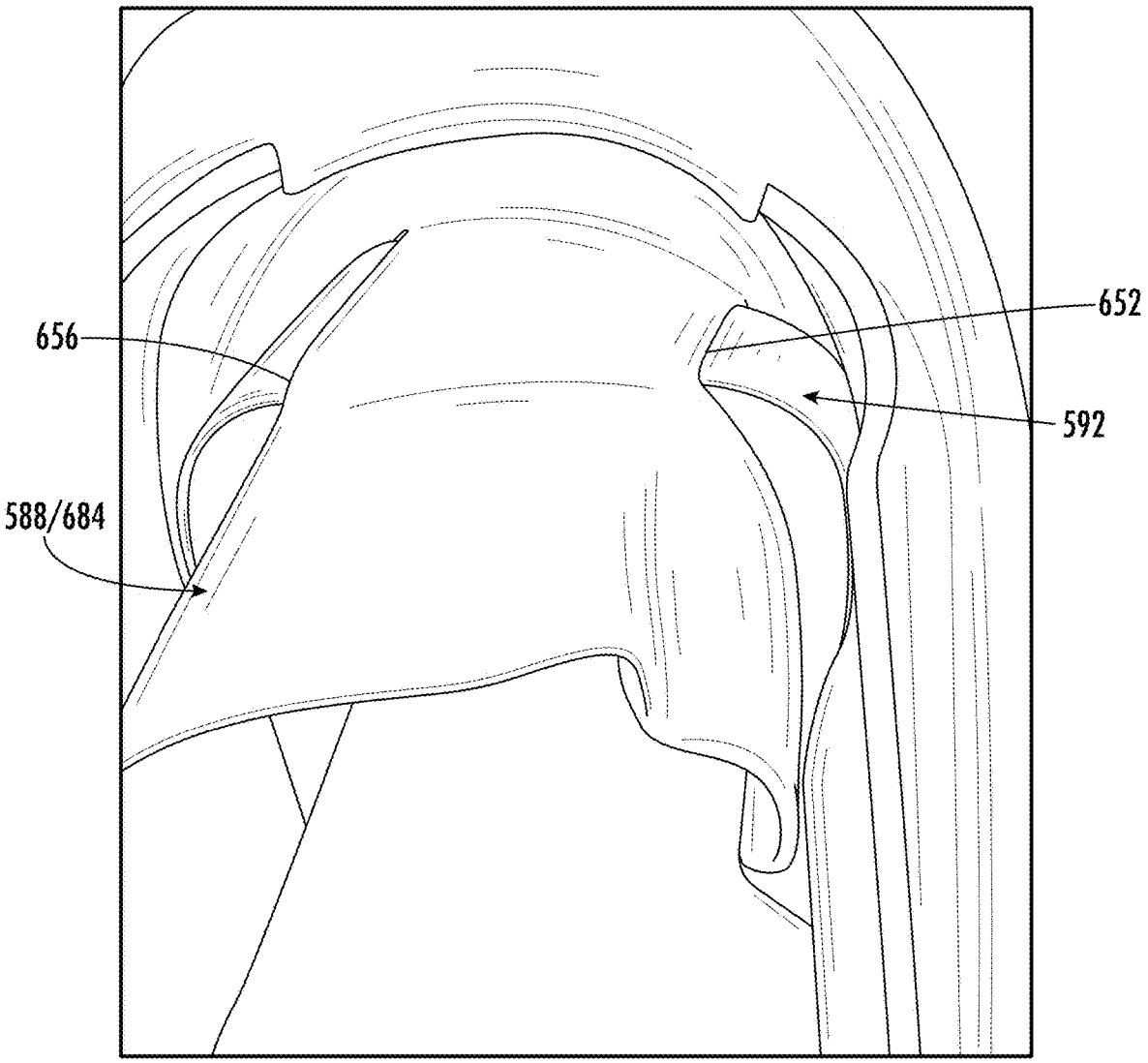
FIG. 16 is an internal view of the foot cavity of the article of footwear shown in FIG. 14A.

FIG. 15B illustrates an article of footwear 680 similar to that described referencing FIG. 15A. The tethered member 588, however, is an internal tongue 684 of uniform transverse dimensions that is secured to the vamp region 532 proximate a throat 688 and extending rearward, toward the collar 568. In addition, the securing strap 592 extends diagonally across the width of the foot cavity 560, with the medial end 660 of the securing strap 592 being oriented forward of the lateral end 664 of the securing strap 592. Stated another way, the securing strap 592 extends rearward, with the medial end 660 of the securing strap 592 being disposed within the midfoot region of the article of footwear 680 and the lateral end 664 of the securing strap 592 being disposed within the heel region of the article of footwear 680. Accordingly, the securing strap 592 spans the width of the foot, beginning proximate the calcaneus or the foot, extending along the instep forward of the ankle, and terminating proximate the midfoot.

The harness system 580 substantially surrounds the access opening 564 and the ankle region of the user. As used herein, the harness system 580 substantially surrounding the access opening and the ankle region of the user means that the harness system 104 circumferentially surrounds at least 60% of the access opening when viewed from directly above the access opening. In some embodiments, the harness system 580 may circumferentially surround at least 75%, at least 85%, or at least 95% of the access opening when viewed from directly above the access opening (i.e. in the views of FIGS. 15A and 15B).

In operation the user stretches the resiliently elastic instep cover region 540 and collar 568. The resilient elasticity of the elastic instep cover region 540 and collar 568 enables the access opening 564 to increase in size, thereby enabling the user to insert his or her foot into the access opening 564. Once the user's foot is situated within the foot cavity 560, the resilient elasticity of the instep cover region 540 and collar 568 tightens around the foot, loosely securing the foot in the foot cavity 560.

Next, the user rotates the actuator 604 in the second rotational direction to reduce the effective length of the cable 600, thereby tightening the securing strap 592 around the foot. With the above configuration, the securing strap 592 cooperates (works) with the tethered member 588 or tongue 684 to apply a rearward and downward force onto the foot disposed within the foot cavity 560. Stated another way, the harness system 580 urges the heel into the heel cup of the article of footwear 500, 680, securing the heel to maintain heel contact with the heel cup that occurs as the foot translates forward (longitudinally) along the sockliner. In addition, the harness system 580 prevents translation of the foot along the transverse axis of the article of footwear 500, 680 (e.g., side-to-side or lateral movement). Moreover, the article of footwear 500 can be donned and doffed quickly and easily since no laces need be tied or untied. Furthermore, the lack of laces enables the top surface of the article of footwear 500 to be flat, which is advantageous for sports in which the user kicks an object such as a soccer ball or an American football.

Figure 17:
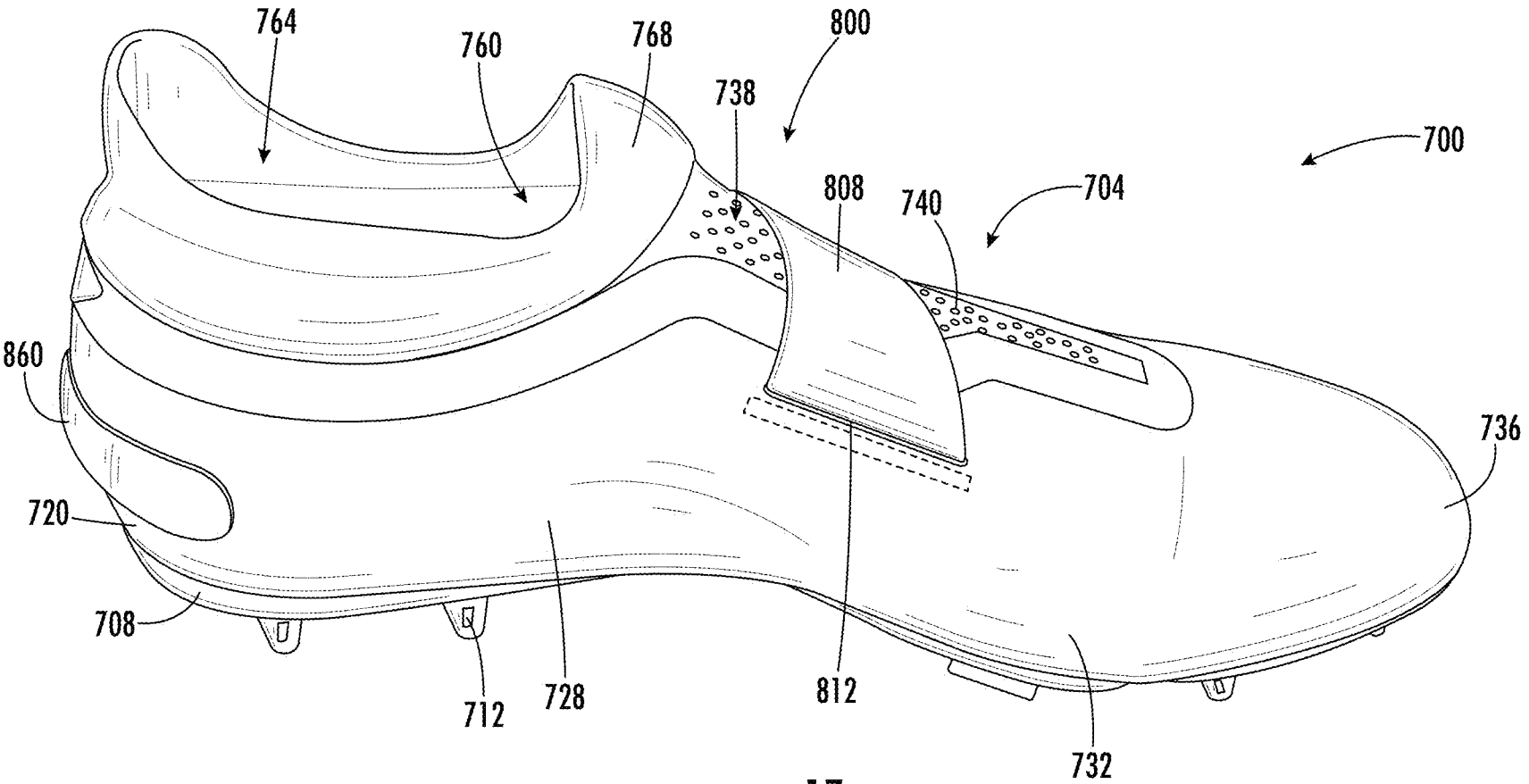
FIG. 17 is a medial side view of an article of footwear having a harness system in accordance with an embodiment of the disclosure.
Figure 18:
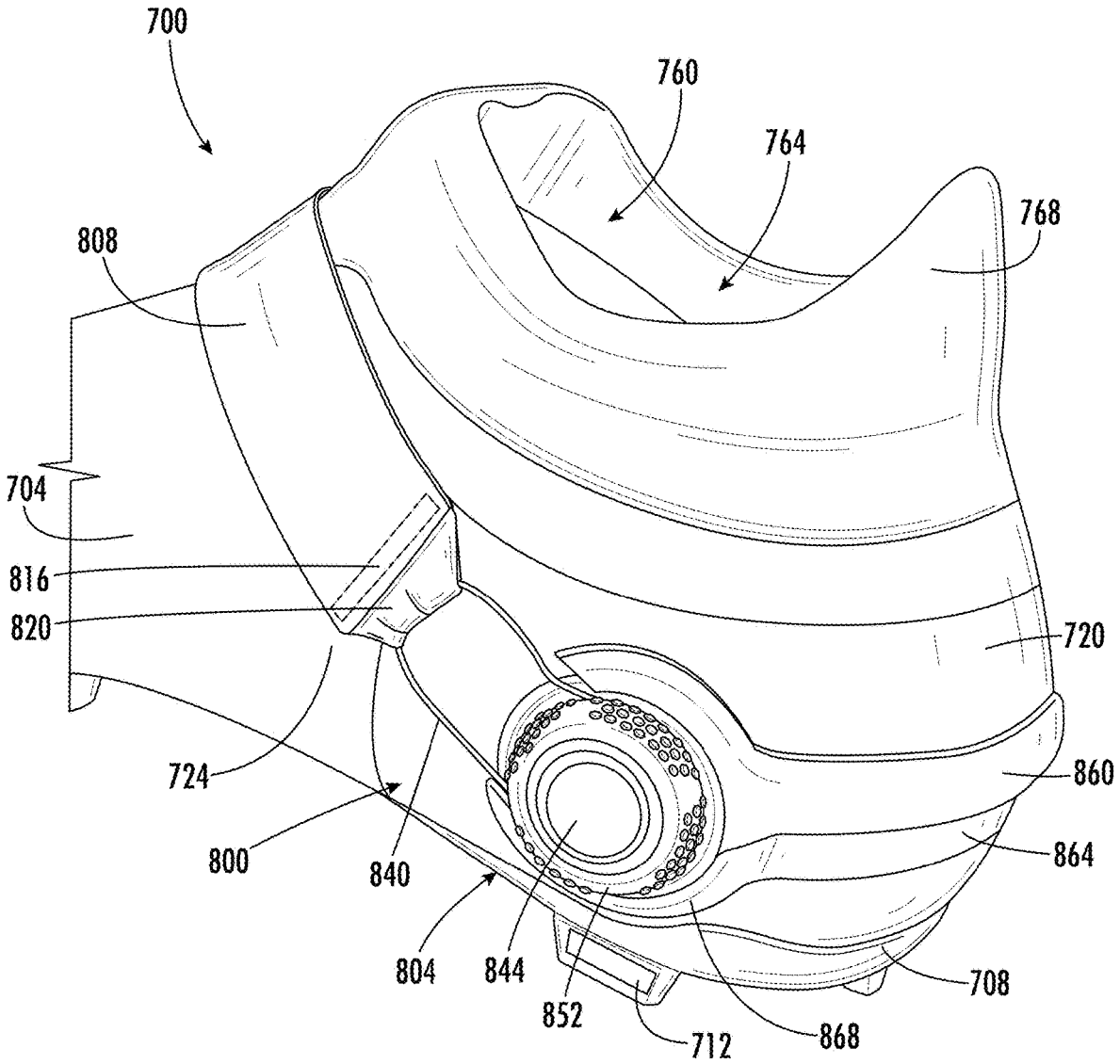
FIG. 18 is a rear-lateral perspective view of the article of footwear of FIG. 17.
Figure 19:
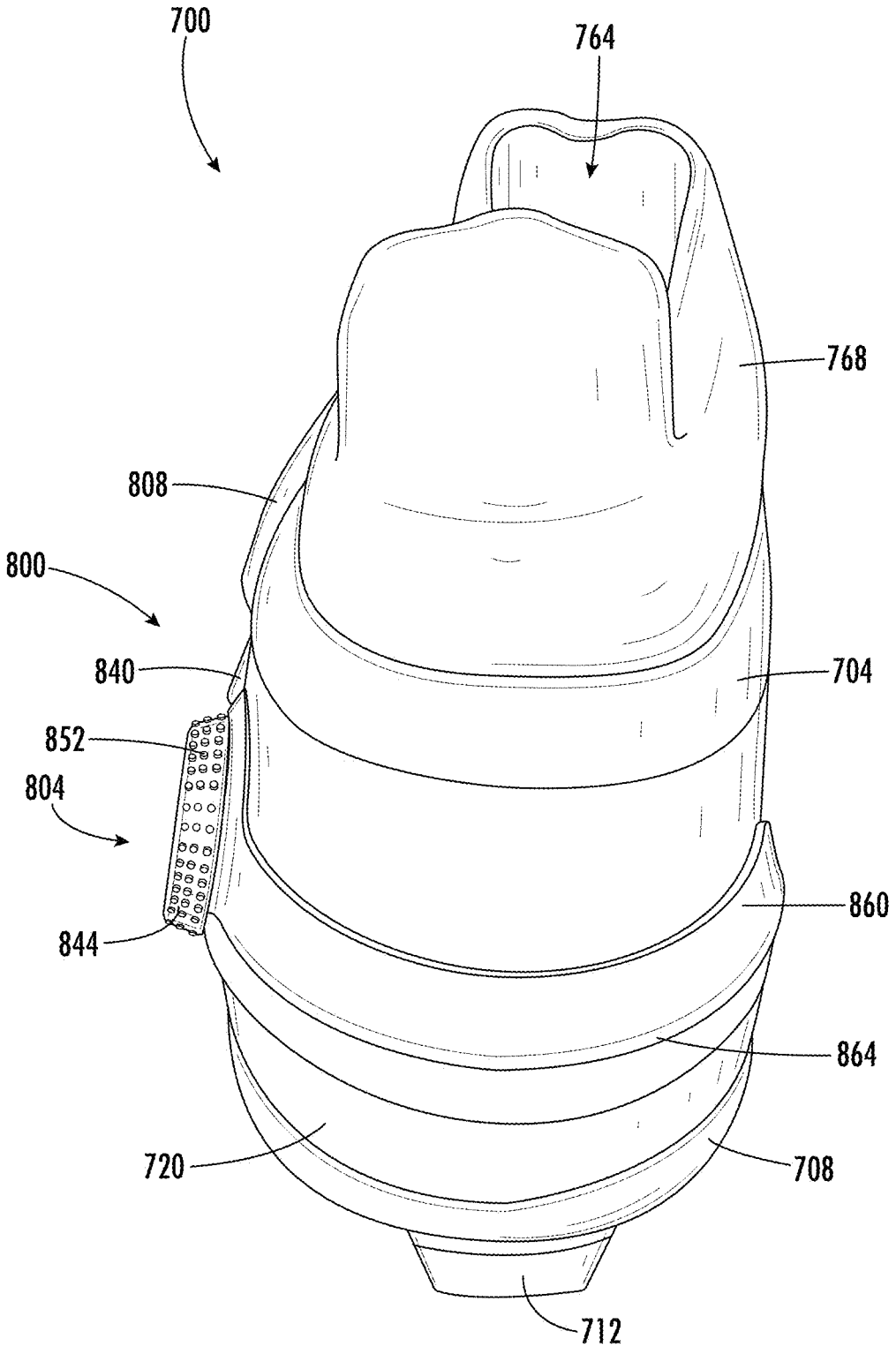
FIG. 19 is a rear view of the article of footwear of FIG. 17.

FIGS. 17-19 illustrate yet another embodiment of an article of footwear 700 that is similar to the embodiment of FIGS. 14A-14D, 15A-15B, and 16, but with the strap on the outside of the upper and instep cover region and with no tethered member. As illustrated in FIGS. 17-19, the article of footwear 700 is stylized as a global football (soccer) or American football cleat, including an upper 704 and a plate 708 with a plurality of traction elements (e.g. cleats) 712. As with the other embodiments described above, the article of footwear 700 defines a forefoot region, a midfoot region, and a hindfoot region, as well as a medial side and a lateral side. The forefoot region generally aligns with the ball and toes of the foot, the midfoot region generally aligns with the arch and instep areas of the foot, and the hindfoot region generally aligns with the heel and ankle areas of the foot. Additionally, the medial side is oriented along the medial (big toe) side of the foot, while the lateral side is oriented along the lateral (little toe) side of the foot.

The upper 704 includes and/or defines a plurality of sections that cooperate to define the foot cavity. A heel region 720 includes heel cup configured to align with and cover the calcaneus area of a human foot. A lateral quarter region 724, disposed forward of the heel region 720, is oriented on the lateral shoe side. Similarly, a medial quarter region 728, disposed forward of the heel region 720, is oriented on the medial shoe side. A vamp region 732 is disposed forward the quarter regions 724, 728, and a toe cage region 736 is disposed forward the of the vamp region 732. A throat 738 is defined between the lateral and medial quarter regions 724, 728 adjacent to the vamp region 732. The throat may be considered to include a throat opening with an instep cover section 740 covering the throat opening. The instep cover section 740 covering the throat opening 738 is configured to align with the central portion of the instep area of the foot and a planum section (not shown), such as a strobel and/or insole underfoot forming a footbed. In this configuration, the heel, lateral quarter, medial quarter, vamp, and toe cage regions 720, 724, 728, 732, 736 cooperate with the plate, strobel, and/or sockliner to define a foot cavity 760 into which a human foot is inserted through an access opening 764 that is defined by a collar 768.

As illustrated in FIGS. 17-19, the instep cover section 740 and the collar 768 are formed of a knit textile structure of unitary construction (e.g., a monolithic or unibody construction). The instep cover section 740 and the collar 768 may be formed of any of the knitted textile materials discussed above with regard to the embodiment of FIGS. 14-16.

The knit construction of the instep cover section 740 and the collar 768 are configured to provide areas of the upper 704 with resilient elastic stretch capabilities, enabling the user to don and doff the article of footwear 700, as well as accommodating expansion during use. The remaining body of the upper 704 (the non-knit areas) are generally formed of materials lacking resilient stretch capabilities. By way of example, the non-knit areas of the upper may be formed of a film or membrane such as leather.

The article of footwear 700 further includes a harness system 800 operable to minimize or prevent translational movement of the foot along the surface of the footbed during use. During game play, a player (e.g., a soccer or football player) engages in repeated acceleration, deceleration, and directional changes. During these actions, the foot has a tendency to shift within the foot cavity 760, sliding along the surface of the footbed (e.g., the sockliner or insole). This sliding not only contributes to slowing the athlete down, but also increases the risk of injury from the toes of the foot repeatedly contacting the interior of the toe cage region 736.

As best seen in FIG. 18, the harness system 800 includes an adjustment mechanism 804 and a securing strap 808. The securing strap 808 extends on the exterior surface of the upper 704 along the transverse dimension of the upper 704 (along the width of the article of footwear), extending on the top surface of the upper 704 from the medial footwear side, across the top side of the throat 738 and instep cover section 740, rearwardly and toward the lateral footwear side.

The securing strap 808 includes a fixed medial end 812 and an adjustable lateral end 816. The medial end 812 is fixed to the article of footwear by, for example, being stitched or fused to the upper 704 in the vamp region 732 and/or the medial quarter region 728. In some embodiments, the medial end 812 may be fixed to the sole 708 or fixed to both the upper 704 and sole 708. The lateral end 816 of the securing strap 808 is coupled to the adjustment mechanism 804 (described in greater detail below) and includes at least one coupling mechanism, for example one or more textile loops 820. As illustrated, the medial and lateral ends 812, 816 may be generally opposed, being positioned on opposite sides of the ankle. As illustrated, the medial end 812 is fixed while the lateral end 816 is adjustable, though the reader should appreciate that in other embodiments the lateral end may be fixed and the medial end may be adjustable.

The adjustment mechanism 804 includes a cable 840 coupled to the securing strap 808, and an actuator 844 operable to adjust the effective length of the cable 840. The cable 840 is filament or wire having sufficient tensile strength to withstand forces placed thereon. By way of example, the cable 840 is a steel wire, or a monofilament line formed of, e.g., nylon, polyvinylidene fluoride (PVDF), or ultra-high molecular weight polyethylene (UHMWPE). As shown, the cable 840 passes over the exterior of the upper 704 and is coupled (e.g., connected) to the securing strap 808 in any suitable manner, for instance by passing through the textile loops 820.

Similar to the embodiments discussed above, the actuator 844 is configured to selectively increase and decrease the length of the portion of the cable 840 extending out from the actuator 844. By way of example, the actuator 844 may be a reel mechanism similar or identical to the actuators described above with respect to the embodiments of FIG. 1-5, 6-13, or 14-16, or in U.S. Pat. No. 9,357,807. The actuator 844 includes a knob 852 in the form of a dial, which is configured to be manually rotated by a user. The cable 840 extends from the actuator 844 and connects to the securing strap 808. The actuator 844 is configured such that, as the knob 852 is rotated in a first rotational direction, the cable 840 unwinds from a reel (not shown) inside the actuator 844, thereby increasing the effective length of the cable 840 (i.e. the length of the cable 840 outside the actuator 844). As the knob 852 is rotated in a second, opposite, rotational direction, the cable 840 winds around the internal reel, thereby reducing the effective length of the cable 840.

The harness system 800 further includes a heel support member 860 positioned along the exterior of the upper 704 proximate the heel region 720. The heel support member 860 is configured to support the actuator 844 and to dampen torsional stress experience by the upper during use. In some embodiments, the heel support member 860 may be similar or identical to the heel support member 200 discussed above with reference to the embodiment of FIGS. 1-5. As shown, the heel support member 860 includes an elongated portion 864 beginning within the heel section on the medial shoe side and extending rearward, across the heel, and to the lateral shoe side. The heel support member 860 further includes a semi-circular frame portion 868 along the lateral shoe side that surrounds the base of the actuator 844. The heel support member 860 may be formed of a substantially rigid, resilient material such as thermoplastic polyurethane, polyurethane, nylon, etc.

As can be seen particularly in FIGS. 17 and 18, the harness system 800 substantially surrounds the access opening 764 and the ankle region of the user. As used herein, the harness system 800 substantially surrounding the access opening and the ankle region of the user means that the harness system 800 circumferentially surrounds at least 60% of the access opening when viewed from directly above the access opening. In some embodiments, the harness system 800 may circumferentially surround at least 75%, at least 85%, or at least 95% of the access opening when viewed from directly above the access opening.

In operation the user first stretches the resiliently elastic instep cover section 740 and the collar 768. The resilient elasticity of the elastic instep cover section 740 and the collar 768 enables the access opening 764 to increase in size, thereby enabling the user to insert his or her foot into the access opening 764. Once the user's foot is situated within the foot cavity 760, the resilient elasticity of the instep cover section 740 and the collar 768 tightens around the foot, loosely securing the foot in the foot cavity 760.

Next, the user turns the actuator 844 in the second rotational direction to reduce the effective length of the cable 840. Since the medial end 812 of the securing strap 808 is fixed to the upper 704, reducing the effective length of the cable 840 causes the cable 840 to pull the securing strap via the textile loops 820. As a result, the securing strap 808 tightens on the exterior surface of the upper 704 and the instep cover section 740.

With the above configuration, the securing strap 808 cooperates with the upper 704 and instep cover section 740 to apply a rearward and downward force onto the foot disposed within the foot cavity 760. Stated another way, the harness system 800 urges the heel into the heel cup of the article of footwear 700, securing the heel to maintain heel contact with the heel cup that occurs as the foot translates forward (longitudinally) along the sockliner. In addition, the harness system 800 prevents translation of the foot along the transverse axis of the shoe (e.g., side-to-side or lateral movement).

It will be appreciated that variants of the above-described and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the foregoing disclosure.

What is claimed is:

1. An article of footwear comprising:

a sole;

an upper including a heel end, a toe end, a medial side, and a lateral side, the upper defining a throat between the medial and lateral sides, and the sole and the upper jointly defining a foot cavity;

a support member extending from a first side of the article of footwear to a second side of the article of footwear;

an actuator fixedly attached to the support member at the first side of the article of footwear; and a securing strap extending across the throat and having a first end operably connected to the actuator and a second end fixedly connected to the second side of the article of footwear, wherein the actuator is a reel mechanism operably configured to selectively (i) draw the securing strap toward the reel mechanism to exert a force on a foot inside the foot cavity to retain the foot against the support member, or (ii) allow the securing strap to move away from the reel mechanism and release said force.

2. The article of footwear of claim 1, further comprising:

a cable connecting the reel mechanism to the securing strap, wherein the first end of the securing strap includes at least one loop, and the cable extends through the at least one loop so as to connect the reel mechanism to the securing strap.

3. The article of footwear of claim 1, wherein the securing strap is arranged inside the foot cavity.

4. The article of footwear of claim 1, wherein the securing strap is positioned external to the foot cavity in contact with an exterior surface of the upper.

5. The article of footwear of claim 4, wherein the upper further comprises an instep cover section extending across the throat.

6. The article of footwear of claim 5, further comprising a collar surrounding and defining an access opening that opens into the foot cavity, the collar formed of an elastically resilient textile material.

7. The article of footwear of claim 5, further comprising a tethered member arranged on an underside of the instep cover section, the securing strap extending through the tethered member.

8. The article of footwear of claim 1, wherein the support member, the actuator, and the securing strap form a harness system that substantially surrounds an access opening that opens into the foot cavity, wherein either (i) the first side of the article of footwear is the medial side and the second side of the article of footwear is the lateral side, or (ii) the first side of the article of footwear is the lateral side and the second side of the article of footwear is the medial side.

9. The article of footwear of claim 1, wherein the support member extends around the heel end and is spaced apart from the sole at the heel end.

10. The article of footwear of claim 1, wherein the support member is formed integrally and unitarily with the sole.

11. The article of footwear of claim 1 wherein a throat opening is defined at the throat.

12. The article of footwear of claim 11 further comprising a plurality of lace eyelets arranged along a perimeter of the throat opening and a lace extending through the plurality of lace eyelets.

13. The article of footwear of claim 12 further comprising a tongue disposed within the throat opening and defining a slot, wherein the securing strap extends through the slot and under the lace and the tongue within the foot cavity.

14. An article of footwear comprising:

a sole;

an upper having an exterior surface, the upper defining a throat between a medial side of the article of footwear and a lateral side of the article of footwear, the sole and the upper jointly defining a foot cavity; and a harness system comprising:

a securing strap extending across the throat from the medial side to the lateral side, the securing strap having a first end and a second opposite end, the first end being fixedly attached to at least one of the upper and the sole on one side of the upper; and an adjustment mechanism including an actuator operably connected to the second end of the securing strap, the adjustment mechanism configured to tighten and loosen the securing strap, wherein the adjustment mechanism further comprises a heel support member extending from the lateral side to the medial side around a heel end of the article of footwear, the heel support member having a frame portion that supports the actuator on a side of the upper that is opposite the one side of the upper.

15. The article of footwear of claim 14, further comprising an instep cover section extending across the throat.

16. The article of footwear of claim 15 wherein the securing strap is arranged under the instep cover section.

17. The article of footwear of claim 15 wherein the securing strap is arranged over the instep cover section.

18. The article of footwear of claim 15, wherein the instep cover section is formed of a first resilient elastic knitted textile, the article of footwear further comprising a collar surrounding and defining an access opening that opens into the foot cavity, the collar being formed of a second resilient elastic knitted textile.

19. The article of footwear of claim 14, wherein the actuator is a reel mechanism operably configured to selectively (i) draw the securing strap toward the reel mechanism to exert a force on a foot inside the foot cavity to retain the foot against the support member, or (ii) allow the securing strap to move away from the reel mechanism and release said force.

* * * * *